US010851674B2

(12) United States Patent
Mei et al.

(10) Patent No.: US 10,851,674 B2
(45) Date of Patent: Dec. 1, 2020

(54) METHOD AND APPARATUS FOR ASSEMBLING NOZZLES BETWEEN BUCKETS OF A TURBINE, PARTICULARLY A GAS TURBINE

(71) Applicant: Nuovo Pignone Tecnologie SRL, Florence (IT)

(72) Inventors: Luciano Mei, Florence (IT); Marco Listori, Florence (IT); Massimiliano Mariotti, Florence (IT); Allesandro Giammarci Giammarchi, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 194 days.

(21) Appl. No.: 15/572,200

(22) PCT Filed: May 6, 2016

(86) PCT No.: PCT/EP2016/060183
§ 371 (c)(1),
(2) Date: Nov. 7, 2017

(87) PCT Pub. No.: WO2016/177881
PCT Pub. Date: Nov. 10, 2016

(65) Prior Publication Data

US 2018/0142575 A1 May 24, 2018

(30) Foreign Application Priority Data

May 7, 2015 (IT) ..... MI2015A0643

(51) Int. Cl.
*F01D 25/28* (2006.01)
*F01D 9/04* (2006.01)
*F01D 5/06* (2006.01)

(52) U.S. Cl.
CPC ..... *F01D 25/285* (2013.01); *F01D 5/06* (2013.01); *F01D 9/04* (2013.01); *F05D 2220/32* (2013.01); *F05D 2230/68* (2013.01)

(58) Field of Classification Search
CPC ... B23Q 3/00; B23Q 3/02; B23Q 3/06; B23Q 3/062; B23Q 3/063; F01D 25/28;
(Continued)

(56) References Cited

U.S. PATENT DOCUMENTS 3,493,212 A * 2/1970 Scalzo ..... F01D 25/26 415/127
2003/0147742 A1 8/2003 Thomas
2009/0317245 A1 * 12/2009 Burns ..... F01D 9/041 415/191

FOREIGN PATENT DOCUMENTS

EP 1 052 377 A2 11/2000
GB 1211313 A 11/1970
JP 2006183486 A * 7/2006

OTHER PUBLICATIONS

Search Report and Written Opinion issued in connection with corresponding IT Application No. MI2015A000643 dated Jan. 8, 2016.

(Continued)

*Primary Examiner* — Tyrone V Hall, Jr.
*Assistant Examiner* — Aaron R McConnell
(74) *Attorney, Agent, or Firm* — Baker Hughes Patent Organization

(57) ABSTRACT

The invention relates to a method and apparatus for assembling nozzles 31 between buckets 41,42 of a turbine, particularly a gas turbine, in which a temporary fixing of the nozzles 31 to the buckets 41,42 during the assembly is provided.

6 Claims, 25 Drawing Sheets

(58) Field of Classification Search
CPC ..... F01D 25/285; F01D 9/04; F01D 5/022; F01D 5/023; F01D 5/06; F05D 2230/68; B25B 11/00; B23K 37/07; B23K 37/0443; B23P 6/002; B23P 2700/13
See application file for complete search history.

(56) References Cited

OTHER PUBLICATIONS

International Search Report and Written Opinion issued in connection with corresponding PCT Application No. PCT/EP2016/060183 dated Jul. 21, 2016.
International Preliminary Report on Patentability issued in connection with corresponding PCT Application No. PCT/EP2016/060183 dated Nov. 7, 2017.

* cited by examiner

METHOD AND APPARATUS FOR ASSEMBLING NOZZLES BETWEEN BUCKETS OF A TURBINE, PARTICULARLY A GAS TURBINE

TECHNICAL FIELD

Embodiments of the subject matter disclosed herein correspond to methods and apparatuses for assembling nozzles rings between buckets of a turbine, particularly a gas turbine.

BACKGROUND ART

In the turbine, particularly gas turbine, field it is along felt need to assemble the turbine components in the most precise way as possible, since errors (for example misalignment or concentricity errors) in the assembly phase always occurs in loss of turbine performance, or mechanical damages to the machine itself.

In the following, with the term "nozzle" will be intended one, or more, stator blades, and a "nozzle ring" is formed by a plurality of adjacent nozzles.

A particular case in which this need is strongly present is when nozzle, particularly those of the high pressure turbine in a turbine engine comprising a compressor a first high pressure turbine and a second low pressure turbine, are to be mounted between two consecutive buckets rows of the turbine rotor.

Since the nozzles (and rings) assembly are part of the stator of the turbine and since they extends and occupy at least part of the available space between the two consecutive buckets, a suitable assembly method shall be provided.

In the known art, most of the nozzles rings are currently assembled into the turbine thanks to the external casing and internal shrouds casings split at least in two halves, nevertheless two halves casing generates asymmetry and are avoided whenever possible.

In an embodiment, full ring casing is preferred to reduce clearances and avoid deformation during operation for better performances; nevertheless with full ring casing in order to assembly the intermediate nozzle ring between the two turbine stages it is needed to unpack the rotor wheels or disassembly at least one bucket stage to allow axial assembly.

It must be considered that the turbine buckets are balanced once mounted on a rotor wheel, comprising all the buckets.

Therefore, disassembling rotor wheels each other or at least one buckets row from wheel for allowing the nozzle and rings mounting can make difficult and expensive the assembly operation in addition to possible rotor unbalancing.

Furthermore, during the assembly operation, it is important to avoid contact between rotor and stator which may damage those components.

SUMMARY

Therefore there is a general need for an improved method and apparatus for assembly nozzles between buckets of a turbine, particularly a gas turbine.

An important idea is to temporary fixing the nozzles to the buckets during the assembly.

Therefore, typically, embodiments of the idea disclosed herein are a method and an apparatus for assembling nozzles rings between buckets of a turbine, particularly a gas turbine.

Particularly, the method for assembling nozzles between buckets of a turbine, particularly a gas turbine, comprises the step of: a. providing a rotor having at least two buckets rows interspaced each other, an operative space in which nozzles are to mounted in an assembled position being provided between the buckets; b. providing a first and a second casing to be coupled each other, said first and second casing being adapted to close said operative space once coupled each other; c. temporary supporting the nozzles to the rotor in said assembled position in the operative space between the buckets; d. coupling said first and second casing each other; e. removing the temporary support of the nozzles.

Correspondingly, the apparatus for assembling nozzles between buckets of a turbine comprising a main pedestal a frame extending substantially vertically from said pedestal, said frame comprising on its turn; a supporting base, more particularly an annular movable base; at least two arms movable with respect of said base; a rotor support, said base being movable along a first direction (X), substantially vertical and said arched arms being movable between a first and a second position in which, in the first position, the arched arms are far removed from the base and in the second position they are near to the latter.

In this way is it possible to achieve a pre-mounting of the turbine rotor and stator pack, which, once realized can be mounted inside the turbine, without the need for further balancing actions.

This allows a more precise assembly of the entire turbine engine and a speedy operation.

This also prevent contact between stator (nozzles) and buckets (rotor) during the mounting operation in the turbine engine.

BRIEF DESCRIPTION OF DRAWINGS

The accompanying drawings, which are incorporated herein and constitute a part of the specification, illustrate exemplary embodiments of the present invention and, together with the detailed description, explain these embodiments.

In the drawings.

DETAILED DESCRIPTION

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
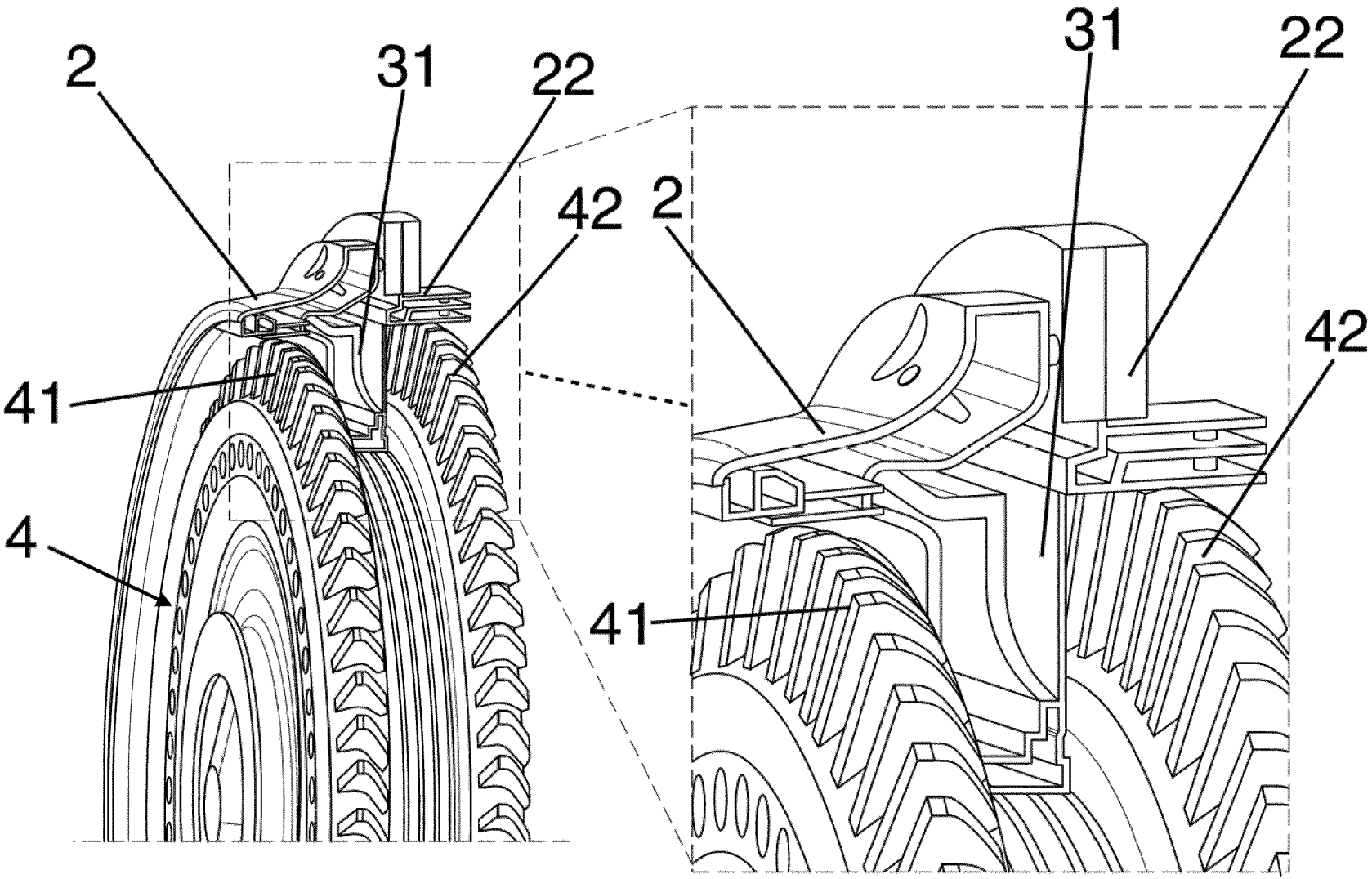
FIG. 1 shows a turbine rotor and related nozzles and an enlarged detail of the same.

Referring to FIG. 1, a turbine (particularly a gas turbine) rotor 4 and nozzles 31 are shown in an assembled condition.

The plurality of nozzles 31, once assembled one adjacent to another, will form a full ring extending in an assembled condition in the operative space between the buckets 41, 42; in said operative space nozzles are to be mounted in an assembled position.

Two full ring casing 2, 22 (first stage annular casing 2 and second stage annular casing 22) are also provided, housing or enclosing both the rotor 4 and nozzles 31; it has to be noted that the casings 2, 22 are not the so called "external casing" since in operation they are usually not visible from the exterior, but will be on their turn enclosed in an external turbine case (not shown) together with other components of the turbine engine.

In FIG. 1 only a portion of the nozzles 31 is shown for sake of clarity.

As can be seen, the rotor 4 comprises two wheels, each provided by its buckets row 41 and 42; the two wheels—as well as the corresponding buckets rows—are spaced each other and the stator nozzles (in an operating condition) comprising the nozzles 31 will be housed in the space between the rotor wheels, and therefore between the buckets rows 41 and 42.

Such two casings 2 and 22 will be assembled together with dedicated fixing devices, such for example bolts or similar; when coupled the two casings 2 and 22 closes the operative space from the exterior.

Figure 2:
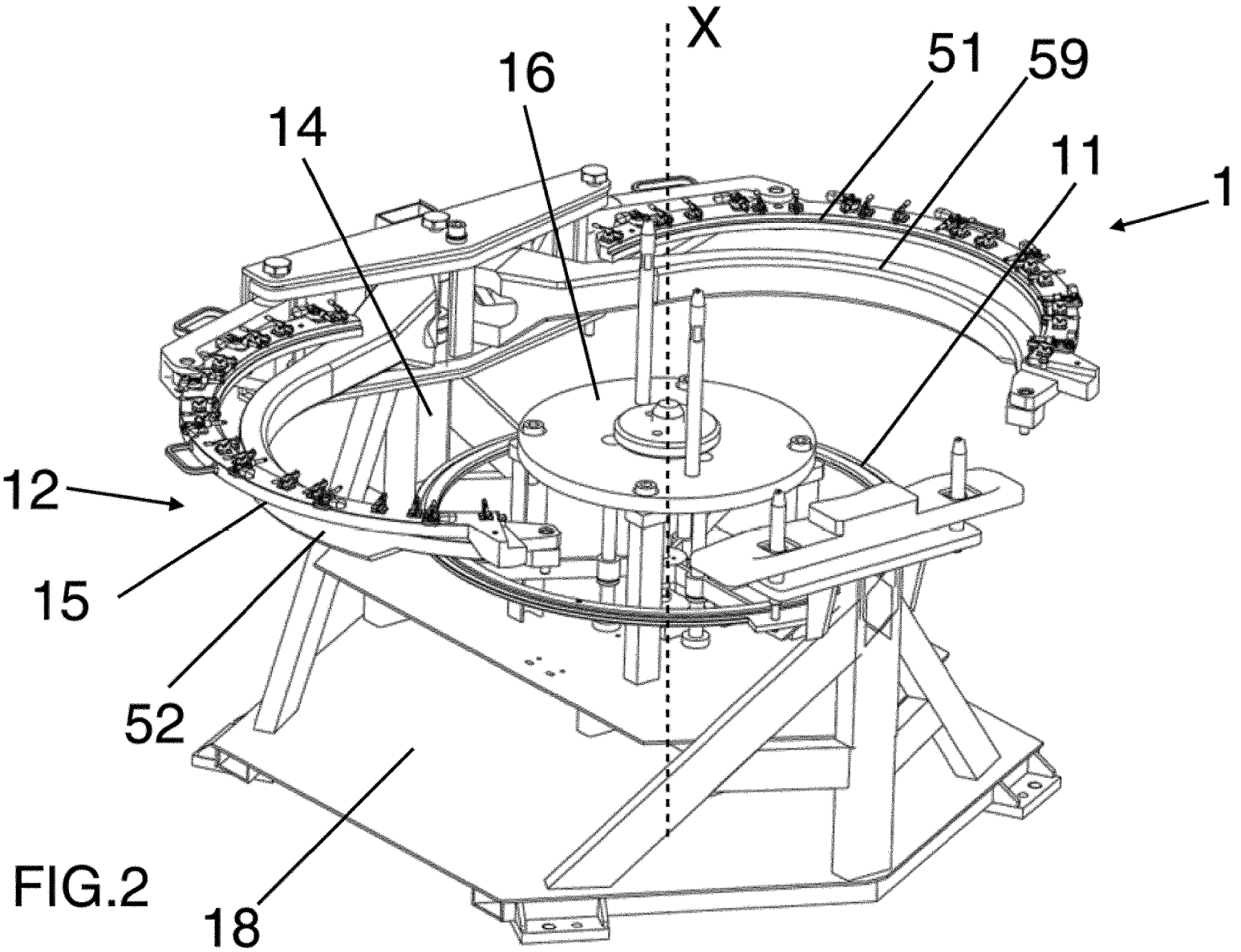
FIG. 2 shows an apparatus for assembly nozzles rings between buckets of a turbine, particularly a gas turbine.

With reference to FIG. 2 an apparatus 1, useful for performing the assembly method is shown; in FIGS. 3-34 the same apparatus 1 is shown in operating condition and in more detail.

The apparatus 1 for assembly nozzles between buckets of a turbine, particularly a gas turbine, comprises a main pedestal 18 and a frame 12 extending substantially vertically from said pedestal 18.

The frame 12 is provided at least by: a supporting base, more particularly an annular movable base 11; at least two arched arms 51,52 movable with respect of base 11; a rotor support 16.

The base 11 is more particularly movable along a first direction X, shown in FIG. 1, substantially vertical (with respect to an operating condition of the apparatus 1) and, in operation, coinciding with the rotation axis of the rotor itself.

The arched arms 51 and 52 are movable between a first and a second position: in the first or opened position they are far removed from the base 11 and in the second or closed position they are near to the latter.

Therefore, the arched arms 51 and 52 are movable in an horizontal plane (with respect to an operating condition of the apparatus 1) towards and away from the base 11; with reference to the X axis, the latter is orthogonal to said horizontal plane.

In an embodiment, the arched arms 51 and 52 are movable between the first and second position by means of a roto-translational movement, while in another embodiment they are movable by a rotation movement and, in yet other embodiment, in a translational movement only.

Consequently, in the non limiting example of the figures, roto-translational hinges (for example in the form of a four-bar linkage) are provided between each arm 51, 52 and an upright 14 the frame 12.

Figure 6:
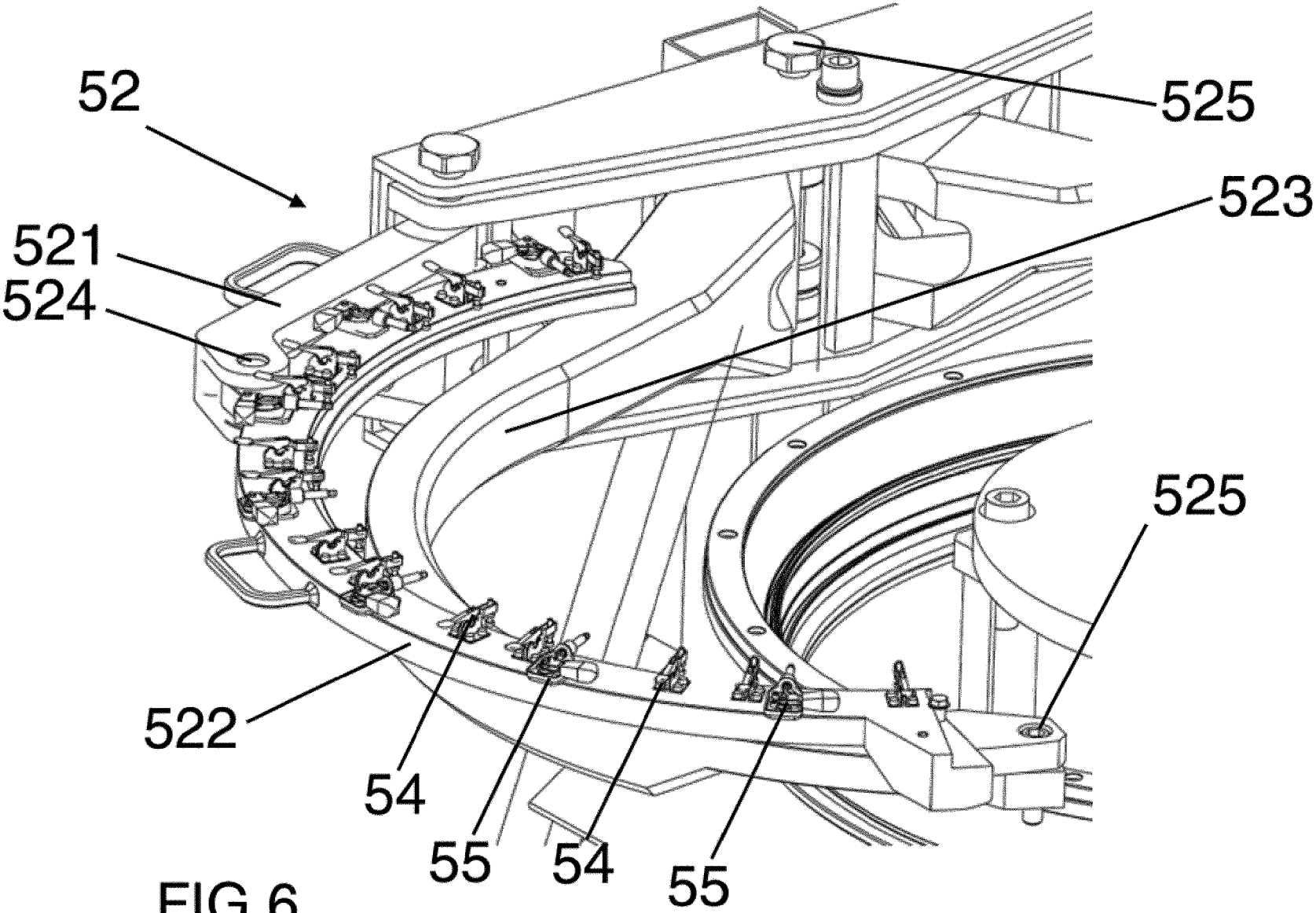
Figure 7:
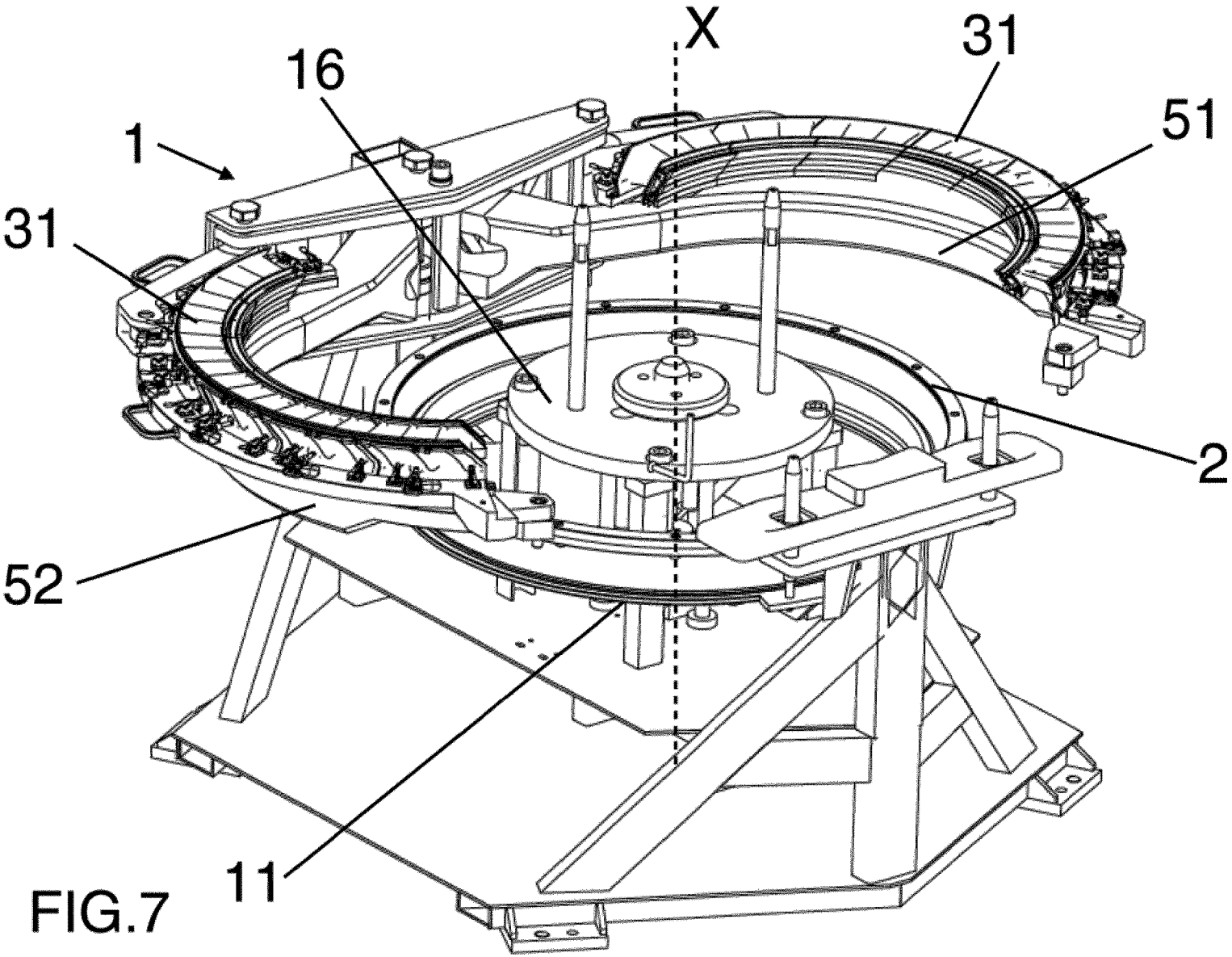
Figures 8, 9:
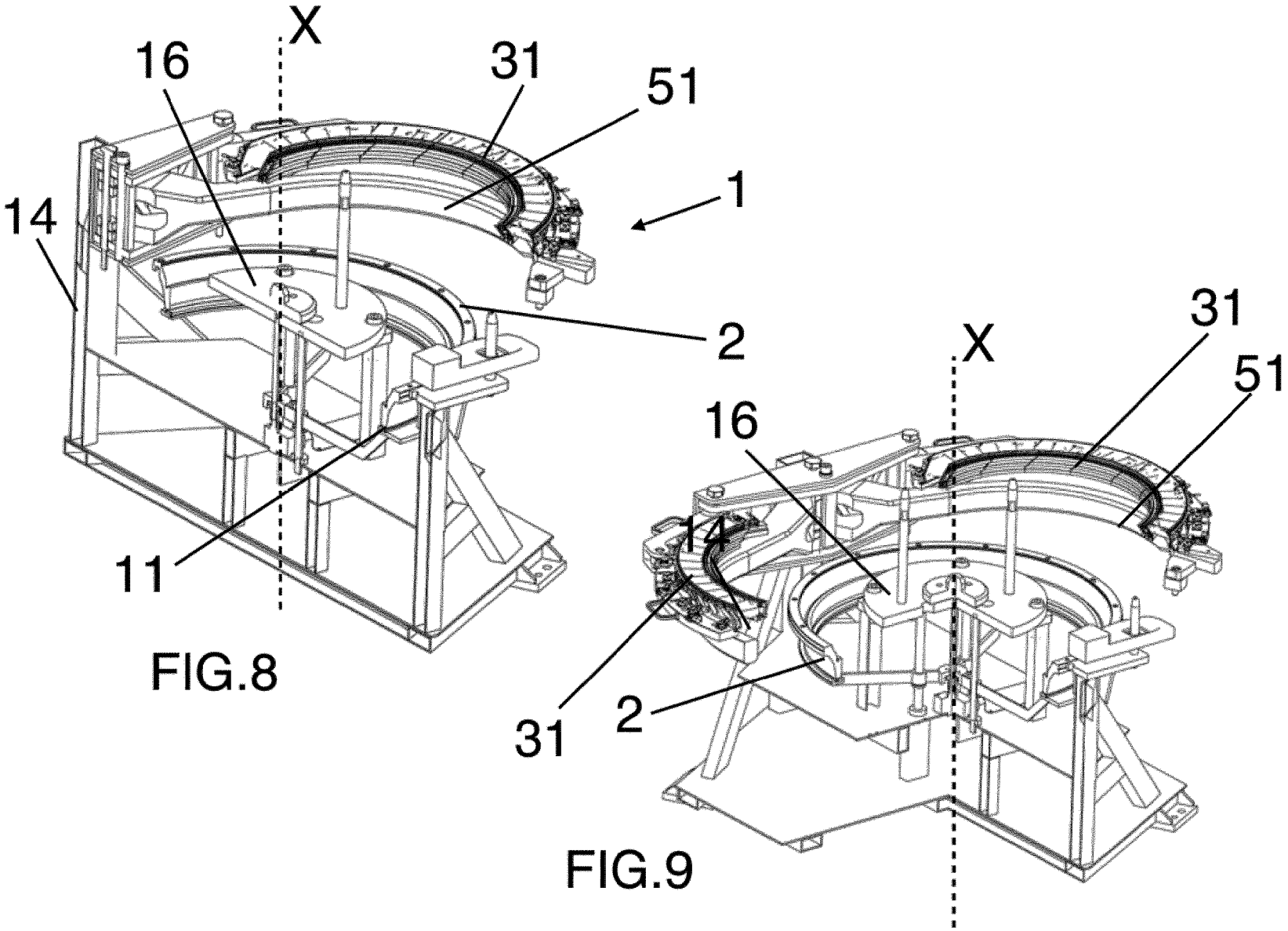
FIGS. 8, 9 and 10 are respectively two partial sectional views of FIG. 7 and an enlarged view of details of FIG. 7.

It must be noted that the two arched arms are indicated as a whole by reference 51, 52; with reference now to the detailed FIG. 6 (in which only arm 52 is shown, arm 51 being substantially identical), each arm 52 (and 51) in an embodiment comprises: a first supporting bracket 521 an arched segment 522 a second supporting bracket 523.

The first and second supporting brackets 521, 523 are each hinged on one side to the frame 12 (more particularly to the ending T-shaped portion of the upright 14) by means of rotational hinges 524 and 525 respectively; the rotation axis of each hinge 524, 525 is parallel to X axis.

On the opposite side, each first and second supporting brackets 521, 523 are hinged to the arched segment 522, by means of hinges 526 and 527; the rotation axis of each hinge 526, 527 is parallel to X axis.

Figure 5:
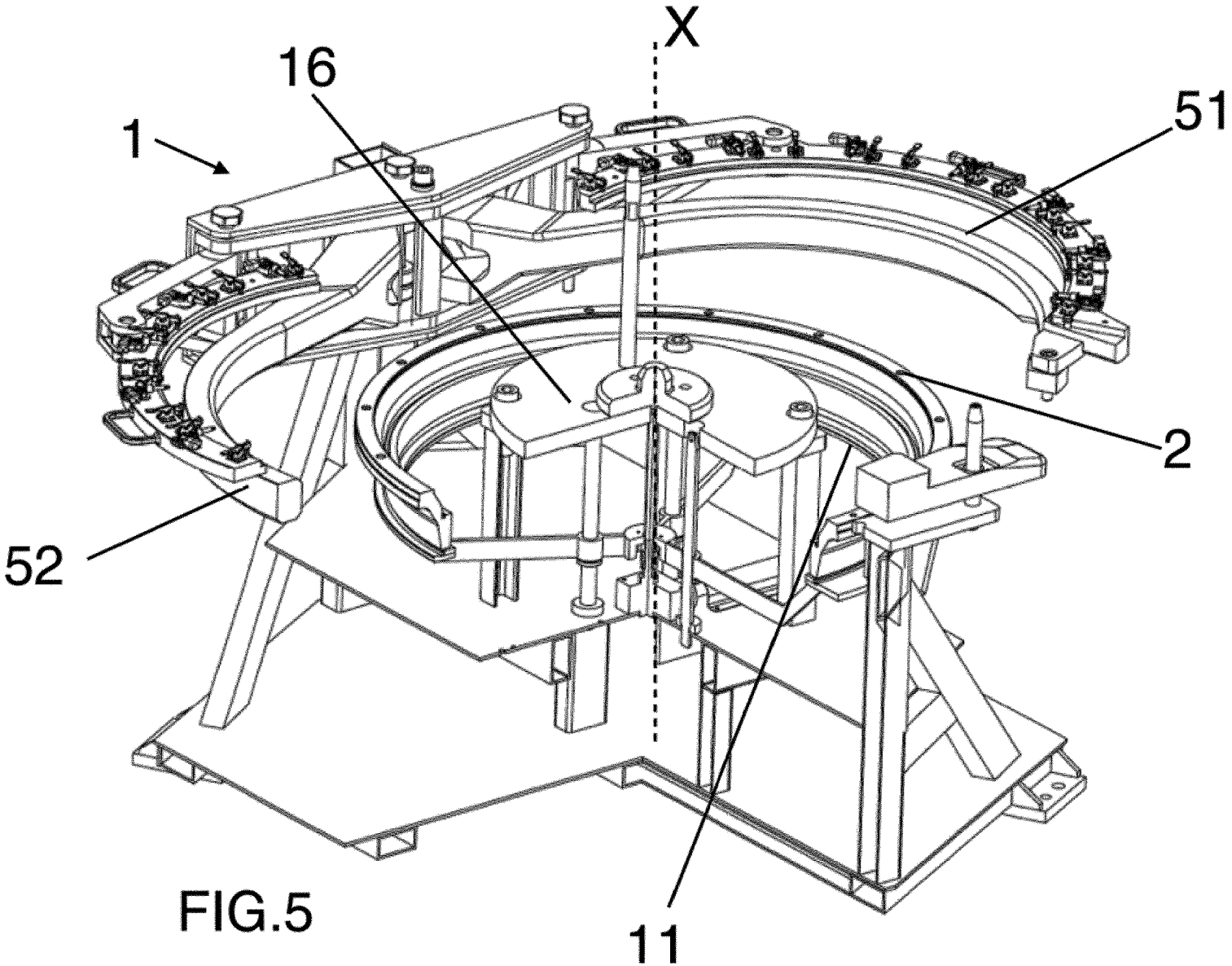
FIGS. 5 and 6 are respectively a partial sectional view of FIG. 4 and an enlarged view of details of FIG. 4.
Figure 17:
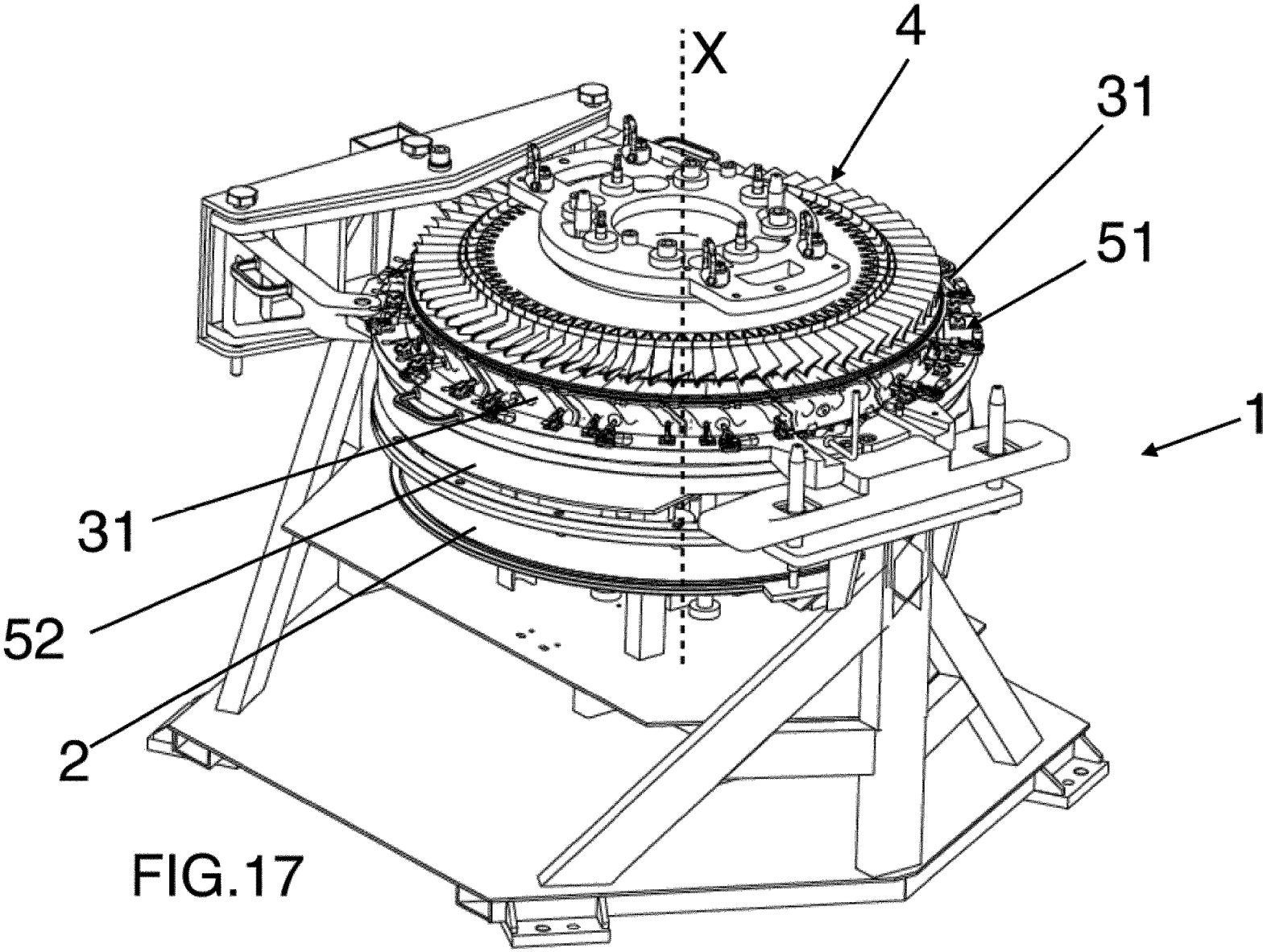

In this way the arched arms 51, 52 moves in the horizontal plane as a four-bar linkage, particularly the arched segment 522 performs a roto-translational movement between the first and second position (first position of opened arched arms as shown—for example—in FIG. 5 and second position, of closed arched arms as shown—for example—in FIG. 17).

Each arm 51, 52 is provided by fixing devices for fixing in a pre-assembled position each nozzle 31.

Figure 10:
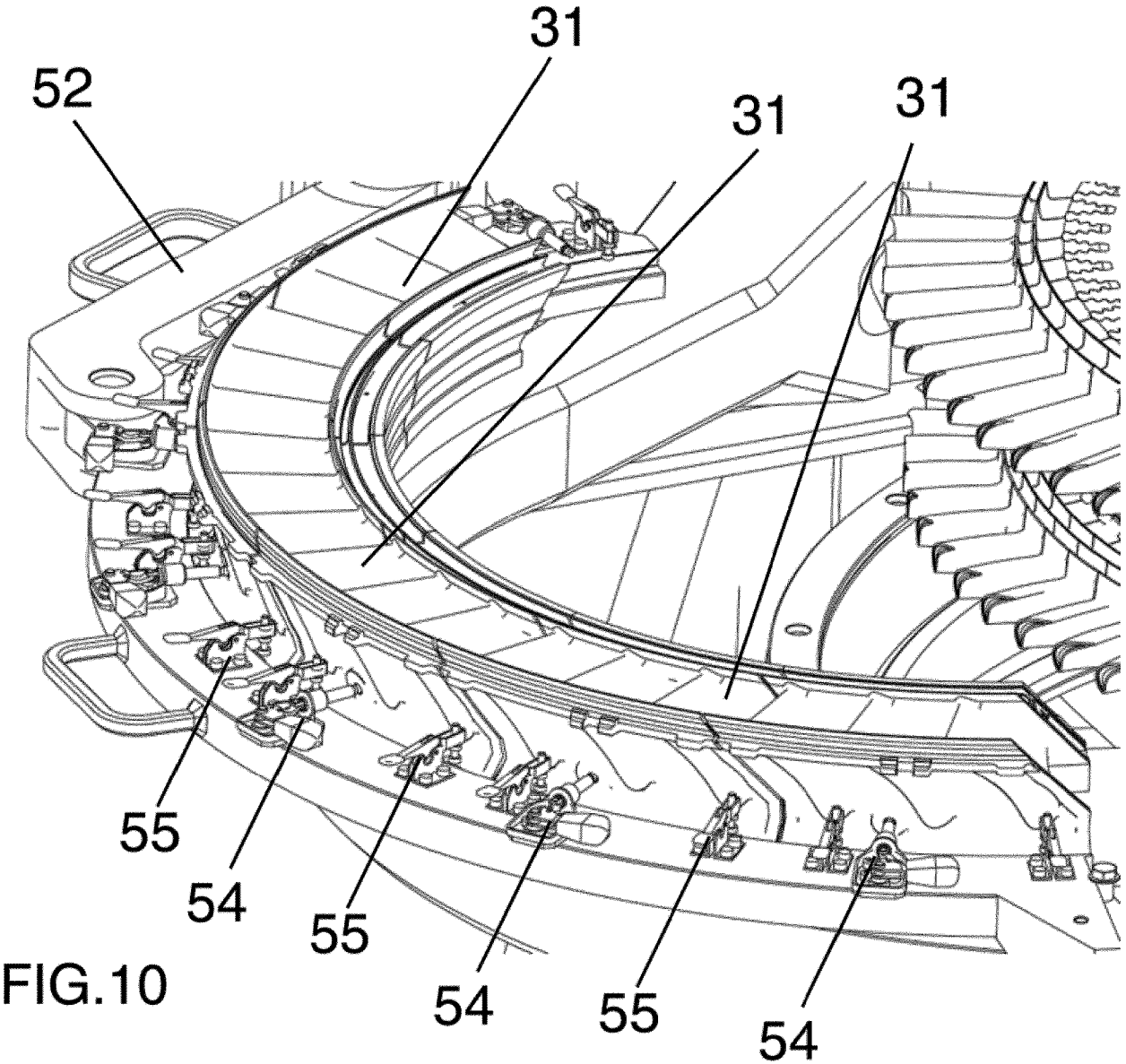

Fixing devices comprises, as shown in FIGS. 6 and 10: a blocking plug 54 for angularly fixing the position of the nozzle 31 with respect to the axis X, a radial abutment 545 an axial blocking lever 55 to prevent axial (with respect to the rotor axis X) movement of the corresponding nozzle 31, particularly by fixing the nozzle 31 against the radial abutment 545.

In an embodiment the blocking plug 54, lever 55 and the abutment 545 are all provided on the arched segment 522.

The radial abutment 545 serves also for supporting the nozzle 31 from below.

The rotor support 16, here in form of a supporting disk, is concentric with the base 11 and provides support and fixing for the rotor 4.

In its general aspects, the method herein described comprises the following steps: a. providing a rotor 4 having at least two buckets 41,42 rows interspaced each other, an operative space in which nozzles 31 are to mounted in an assembled position being provided between the buckets 41,42; b. providing a first and a second casing 2,22 to be coupled each other, said first and second casing 2,22 being adapted to close said operative space once coupled each other; c. temporary supporting the nozzles 31 to the rotor 4 in said assembled position in the operative space between the buckets; d. coupling said first and second casing 2,22 each other; e. removing the temporary support of the nozzles 31.

In an embodiment, the rotor 4 at step a. of the method is already in an assembled and balanced condition and it remains in said condition through the entire method steps.

Optionally, as in the embodiment herein described, the method provides also for a step b1. of axially and radially positioning at least part of the nozzles 31 with respect to said rotor in a pre-assembled position remote from the operative space, said step b1 being executed before step c.

Optionally, as in the embodiment herein described, the method provides also for a step b2., after the step b1., of inserting the nozzles 31 in the operative space between the buckets 41,42 so as to form a nozzle ring in said assembled position in the operative space.

In an embodiment said step b2. comprises a nozzle movement toward said operative space between the buckets according to a trajectory chosen between a roto-translational trajectory, a rotational trajectory or a translational trajectory, still more particularly a roto-translational trajectory.

In an embodiment, in the step c. it is provided for a temporary support of the nozzle ring on said rotor 4 by means of temporary supporting devices, more particularly cable ties.

The fact that the rotor 4 is already assembled and balanced and it remains in such condition through the entire method steps, allows for avoiding a disassembly of the rotor 4 and the necessity for further balancing the latter, therefore avoiding the prior art limit above indicated.

In an embodiment, one can also look at FIG. 3-34 for better understanding the method step that already described.

In those FIGS. 3-34 use of an apparatus 1 (as above described) is made, but it must be understood that, more in general, different apparatuses can be used.

Figure 3:
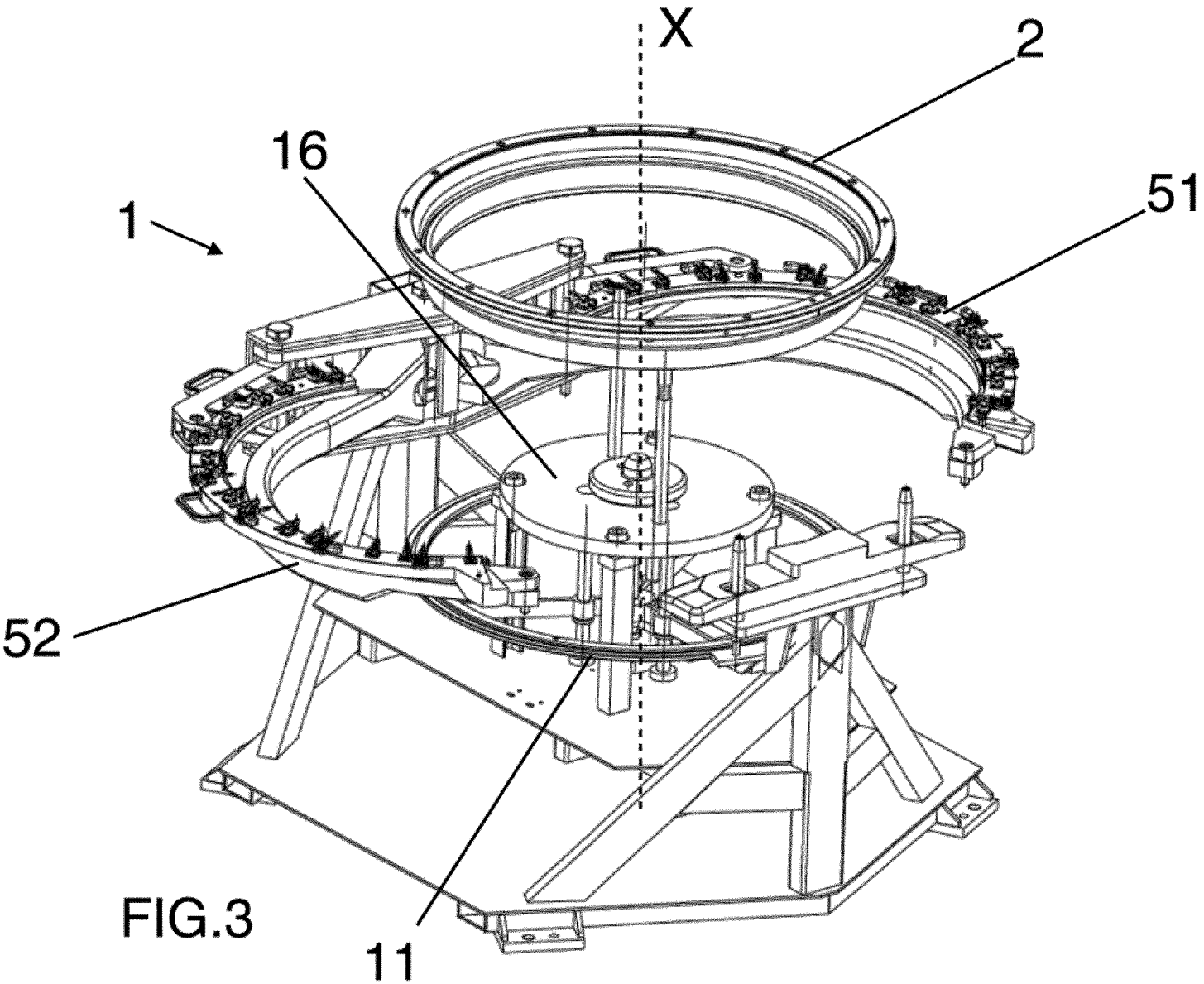
FIG. 3, 4, 7, 11, 14, 17, 20, 23, 26, 29, 32 shows different step of a method for assembly nozzles rings between buckets of a turbine, particularly a gas turbine, using an apparatus according to FIG. 2.
Figure 4:
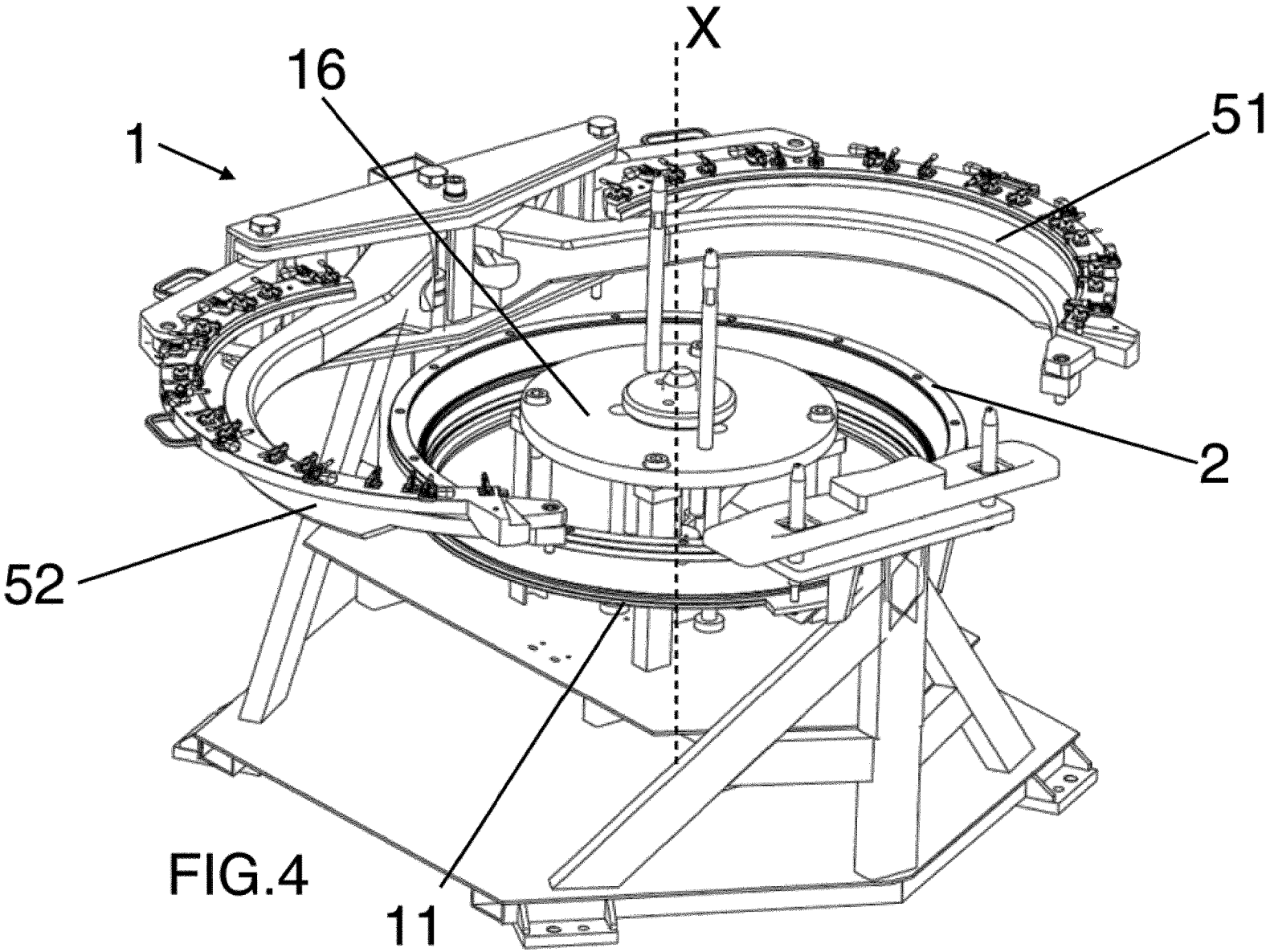

In FIG. 3 it is provided an annular casing 2; particularly, standing the use of the apparatus 1 as above described, the turbine first stage annular casing 2 is supported in a substantially horizontal position, so that it lies on an horizontal plane, substantially parallel to the ground, as can be seen in FIG. 4, in which the annular casing 2 is supported on the base 11 of the assembly apparatus 1.

As one can notice in this method step the arched arms 51, 52 are kept in the first, open, position and the support 11 is in a lowered position.

Figure 11:
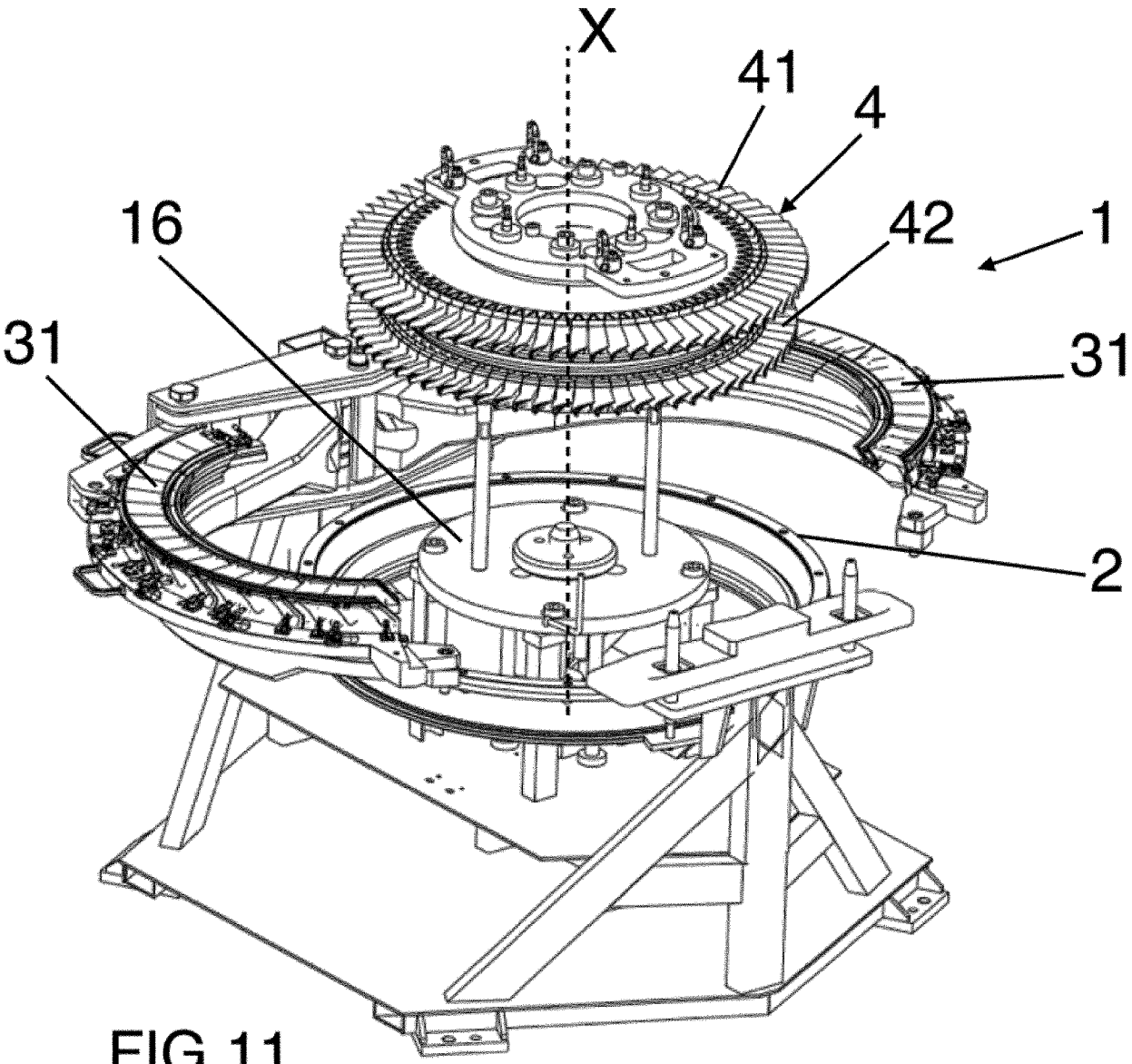
Figure 13:
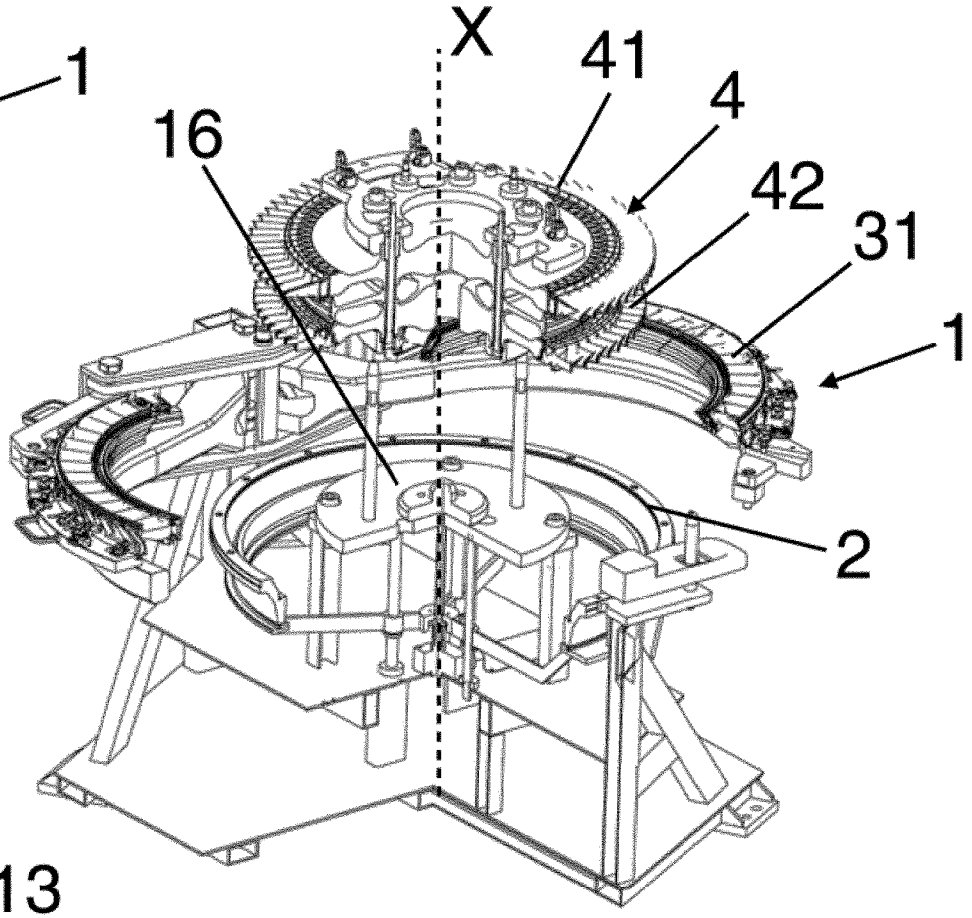
FIGS. 12 and 13 are partial sectional views of FIG. 11.
Figure 12:
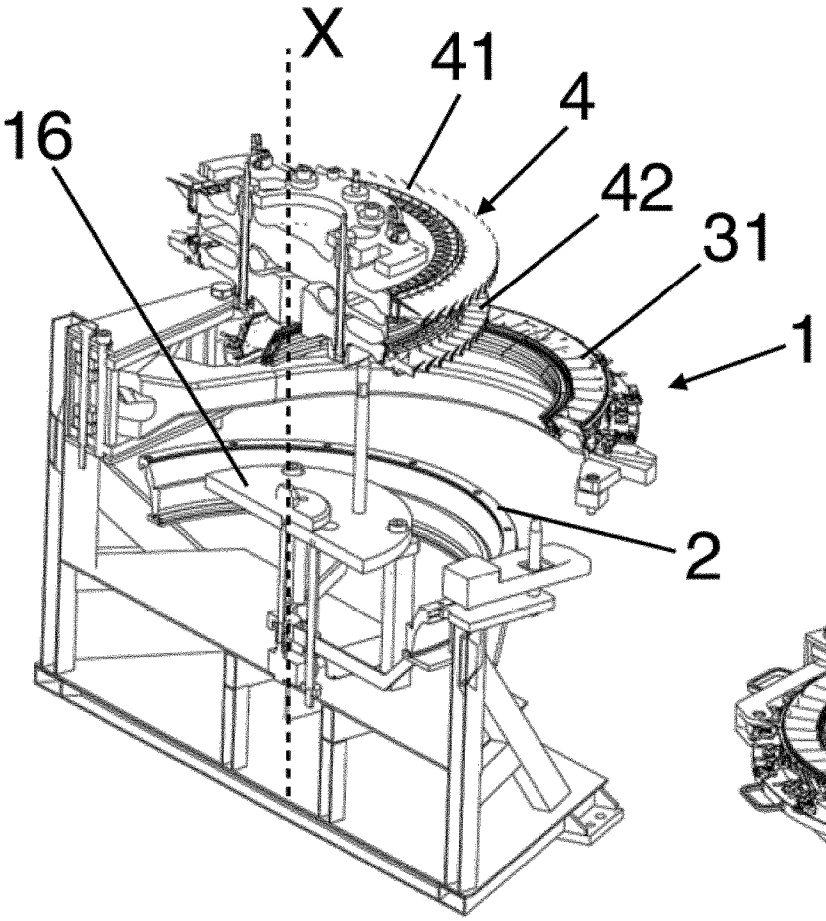
Figure 14:
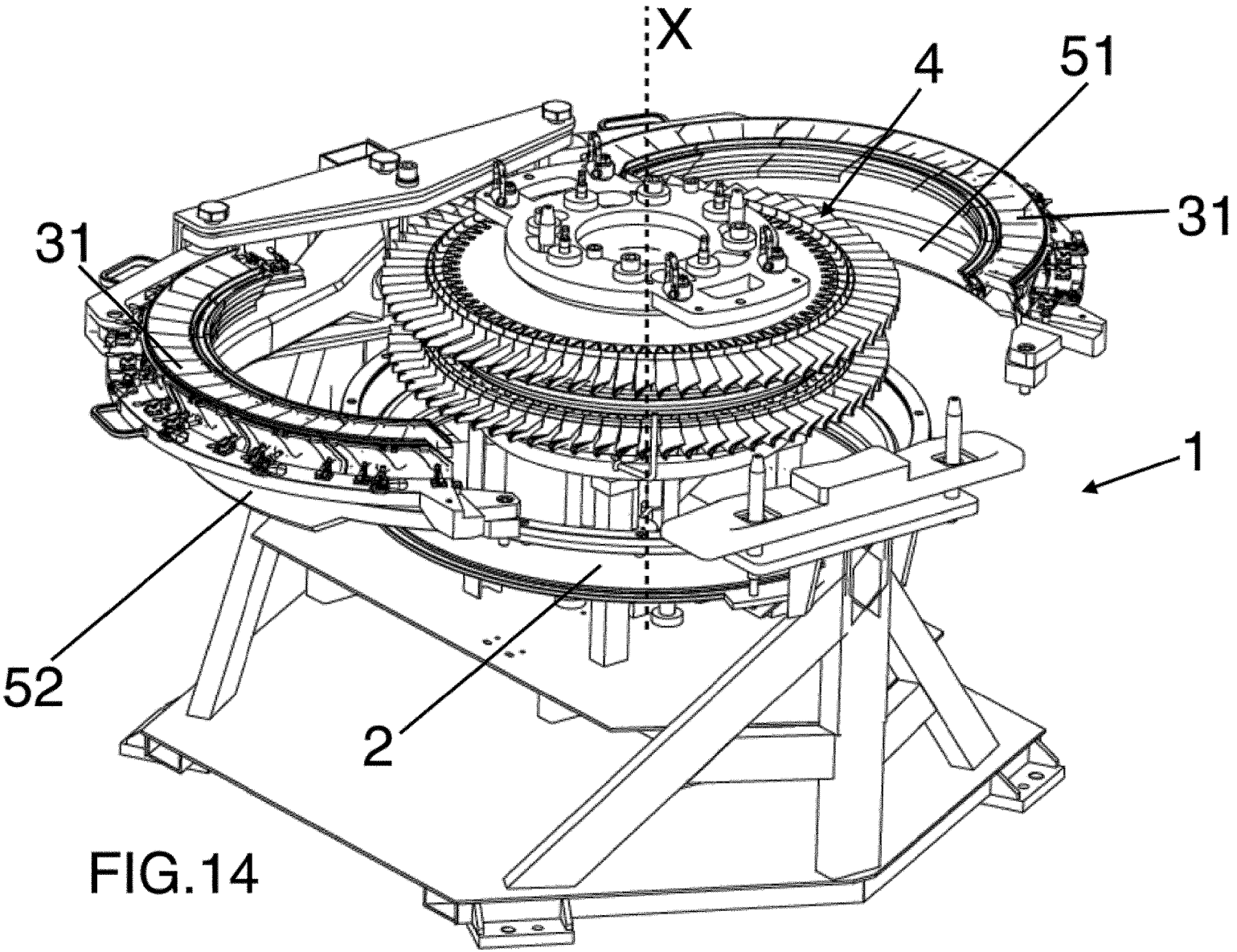
Figure 15:
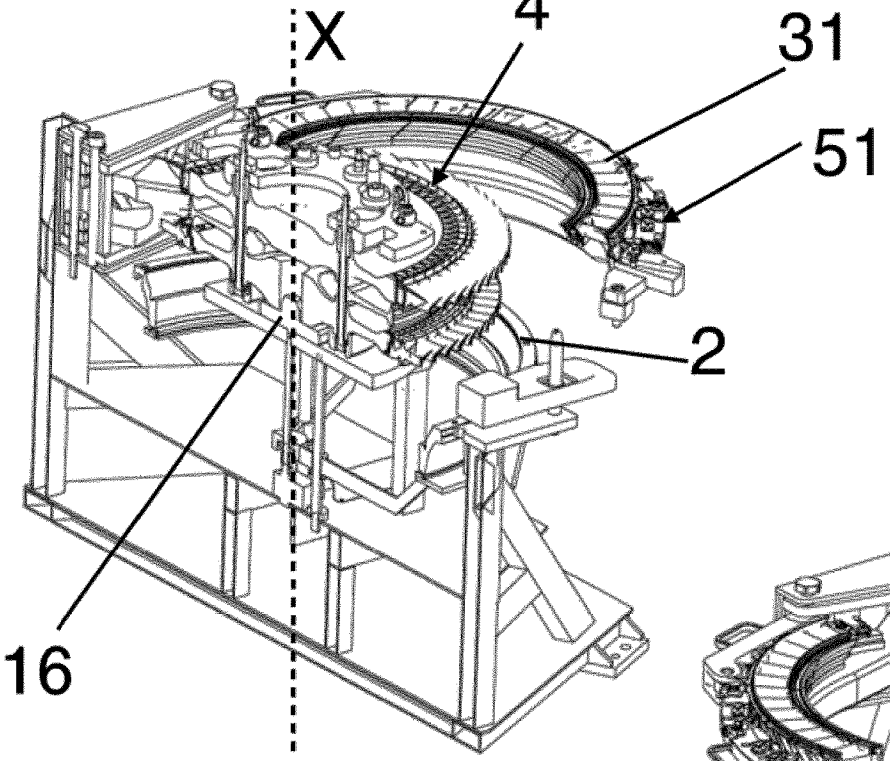
FIGS. 15 and 16 are partial sectional views of FIG. 14.
Figure 16:
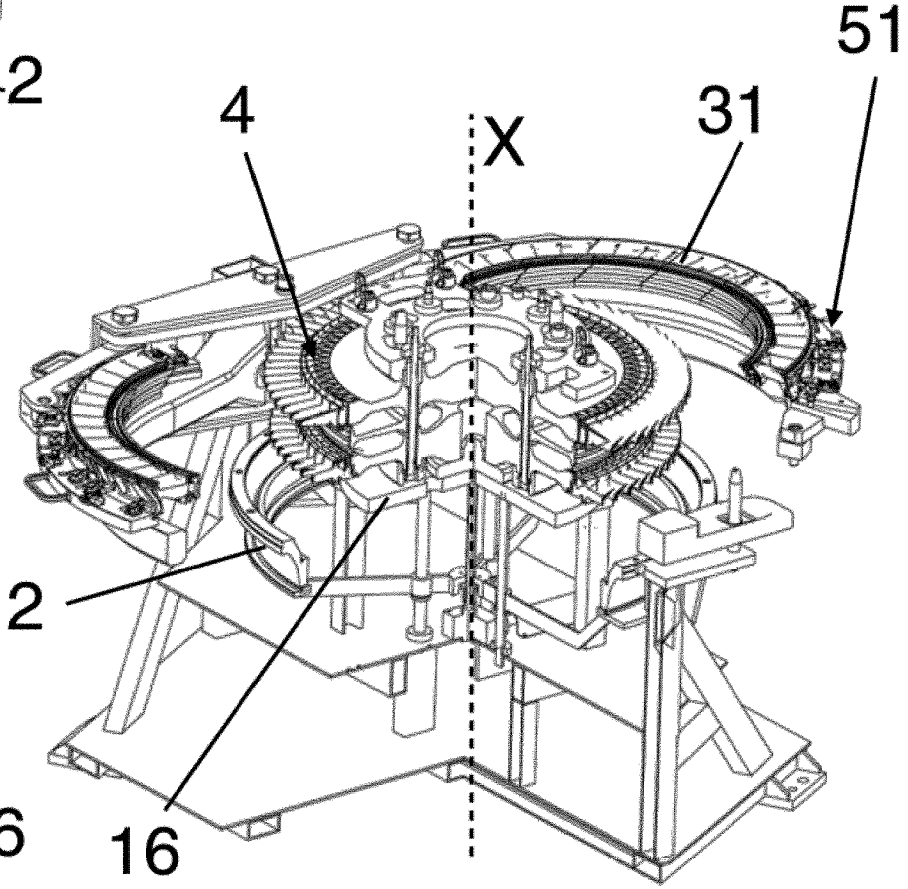

In FIG. 11-13 the rotor 4 is provided; as already said, in this stage the rotor 4 (comprising two row of interspaced buckets 41,42) is more particularly already assembled and balanced; rotor balancing takes place before this step, through known methods which will not be described here in detail.

With reference to the apparatus 1, the rotor is supported by the central supporting device 16 in a position at a different height than that of the annular casing 2, so that the operative space between the buckets 41, 42 remains free and accessible from a radial (with reference to the X axis) direction.

In FIG. 7-10 an axially and radially positioning of the nozzles (with respect to said rotor) takes place in a pre-assembled position as shown.

Each nozzle 31 is properly positioned in a pre-assembled position and there fixed: in the pre-assembled position the nozzles 31 are not yet inserted in the operative space between the buckets, but are remote from that space (in a "mounting" space remote from the operative space); in such pre-assembled position the nozzles are, at least, properly angularly and axially disposed with respect to the rotor axis of rotation.

The nozzles 31 are then fixed in such pre-assembled position so that the reciprocal orientation between nozzle 31 supported by the same arched arm 51 or 52 does not change in the following method steps.

The nozzles 31 are fixed in the pre-assembled position in the operative space when the two arms 51,52 are in the first, opened, position, as shown in the attached FIG. 7-10.

Particularly, with reference to the apparatus 1, a support of first and a second group of nozzles 31 respectively on at least a first and a second supporting arched arms 51,52 of the apparatus takes place.

First (or second) group of adjacent nozzle 31 supported by arm 51 (or 52) forms—in this embodiment—an half nozzle ring; to this extent each nozzle 31 of the first or second group is adjacent to at least one nozzle of the same group, so that each arm 51 or 52 carry all the nozzle 31 of the same group (either first or second group).

One can notice that in such pre-assembled position the arched arms 51, 52 are far removed from the rotor 4 (opened position), so that the first and second group of nozzles (one for each arm) are not still in the operative space between the buckets, yet already angularly positioned for a proper mounting when moved in the operative space itself; this allows for a correct an simple mounting of the nozzles 31 in the two group.

For fixing in the pre-assembled position the nozzles, fixing devices of each arm 51, 52 as above described can be used.

Particularly, the blocking plug 54 serves for angularly fixing the position of the nozzle 31 with respect to the rotor axis of rotation (coinciding with axis X of FIG. 2), while the arm 51, 52 itself provides for a radial abutment 545 of each nozzle (preventing radial displacement with respect to the rotor axis of rotation) and the axial blocking lever 55 as well as the abutment 545 prevent axial (with respect to the rotor axis of rotation X) movement of the corresponding nozzle 31.

Figure 18:
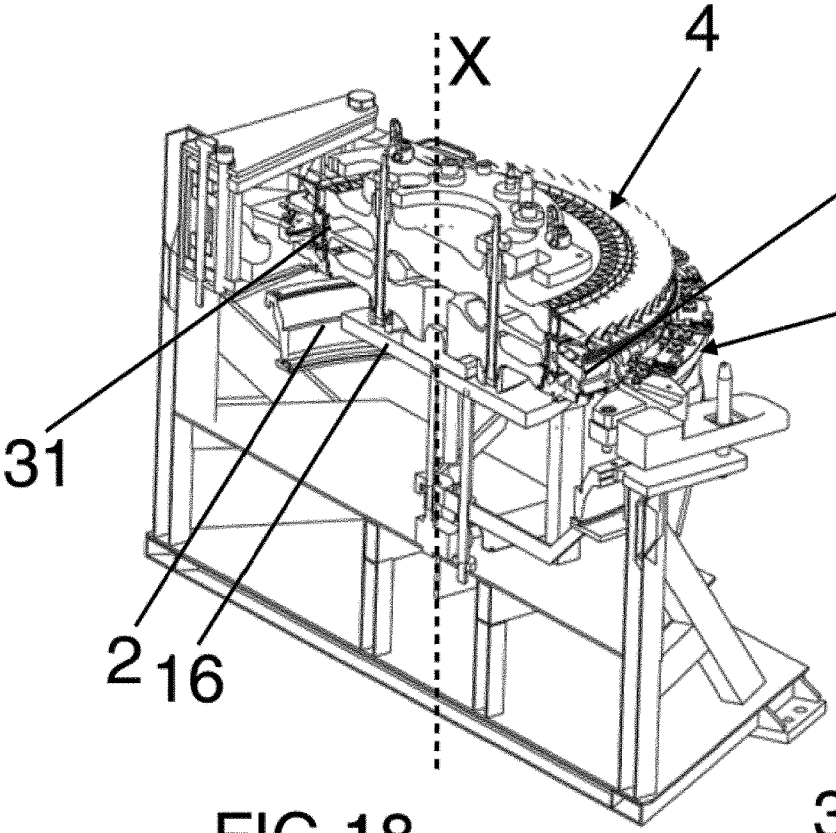
FIGS. 18 and 19 are partial sectional views of FIG. 17.
Figure 19:
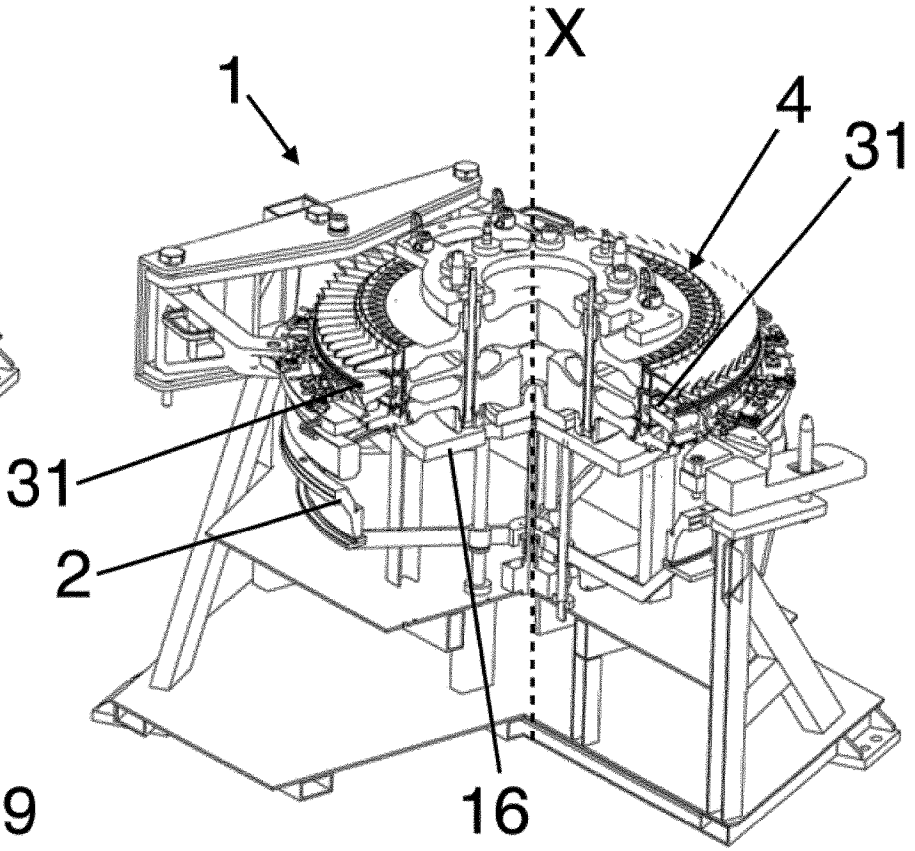

Once fixed in the pre-assembled position, the nozzles 31 are moved and inserted in the operative space between the buckets so as to form a nozzle ring in an assembled position, as shown in FIG. 17-19.

To this extent, when the apparatus 1 is used, the two arms 51, 52 are moved from the first (opened) to the second (closed) position, thereby moving the first and second group of nozzles in the operative space between the buckets of the rotor 4.

As already specified, such movement can be achieved through different trajectories, according to the circumstances: a roto-translational movement, a rotational movement or a translational movement between the first and second position of the arched arms 51, 52.

In this way the two nozzle group are joined together and the nozzle ring is formed in the assembled position between the buckets 41,42 and across the rotor (in the operative space); formation of the ring is important to allow to the second stage casing 22 to be inserted in the diameter generated by the nozzle ring so formed.

In order to keep the nozzle 31 ring so formed in position (necessary for allowing subsequent removal of the arms 51, 52) it is provided to temporary support the nozzle ring on the rotor 4, by means of temporary supporting devices (not shown) acting at least between the rotor 4 and the nozzles 31 so as to couple the two.

Temporary supporting devices can be of different types, such for example cable ties, wires, or similar; temporary support is, in this example, achieved by suspending the nozzle ring already in the operative space to the rotor 4 which is supported—on its turn—by the rotor support 16 of the apparatus 1.

Figure 20:
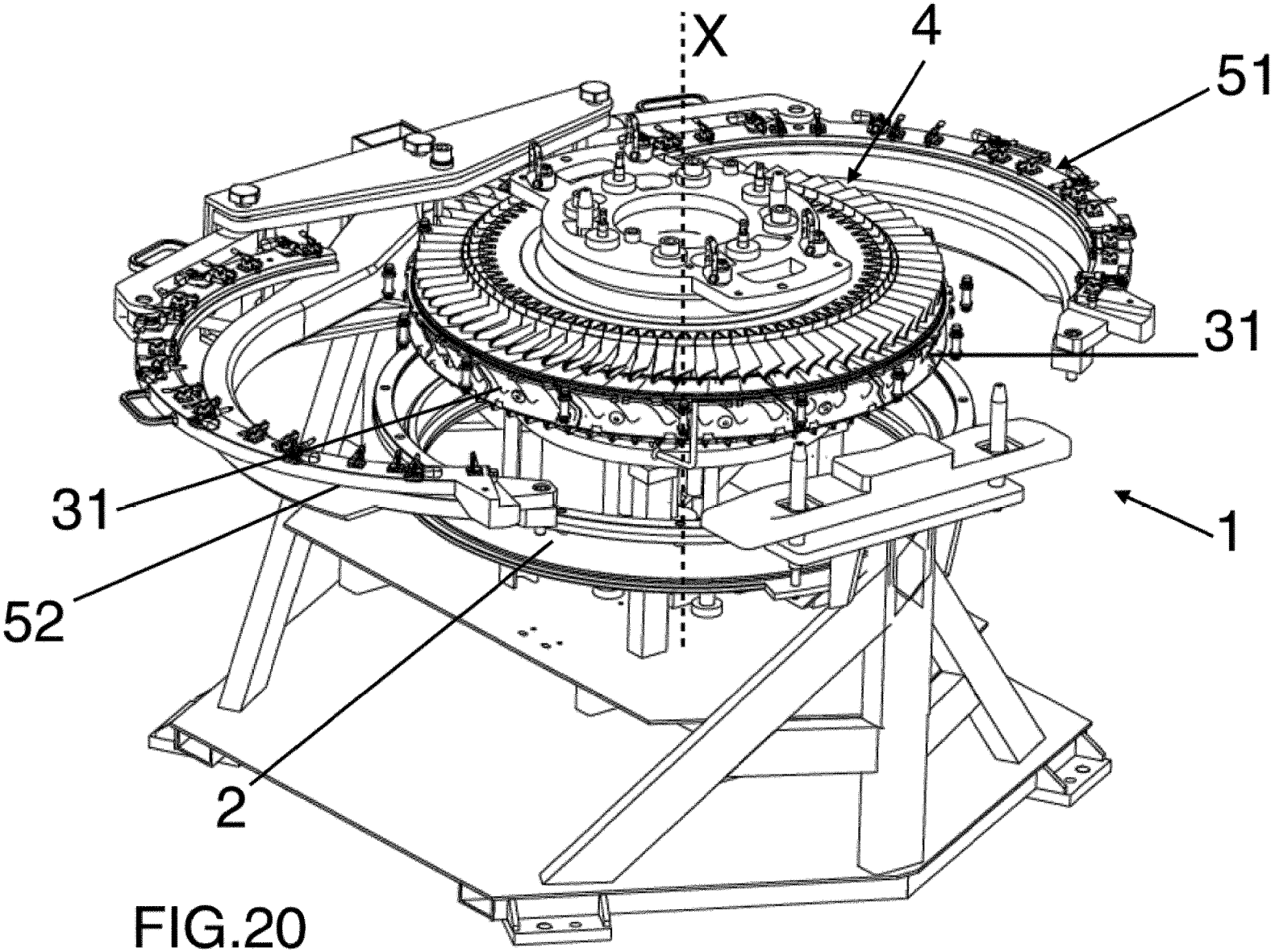
Figures 21, 22:
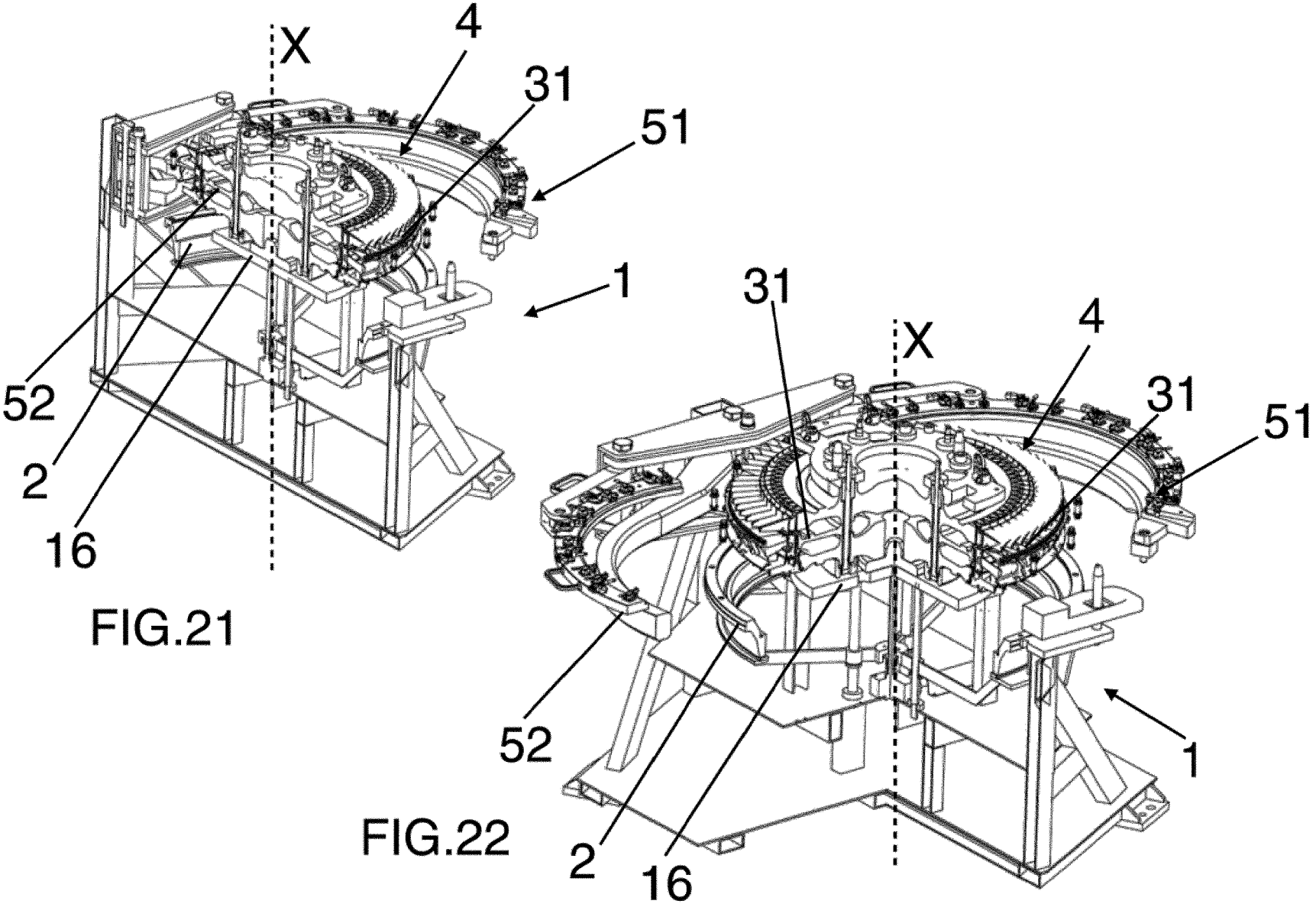
FIGS. 21 and 22 are partial sectional views of FIG. 20.

Once temporary supported in position, the nozzle 31 are released from the arched arms 51,52, as shown in FIG. 20-22; arms 51 and 52 are then moved again in the first, opened, position, leaving the nozzles 31 ring so formed fixed in the operative space between the buckets.

Figure 23:
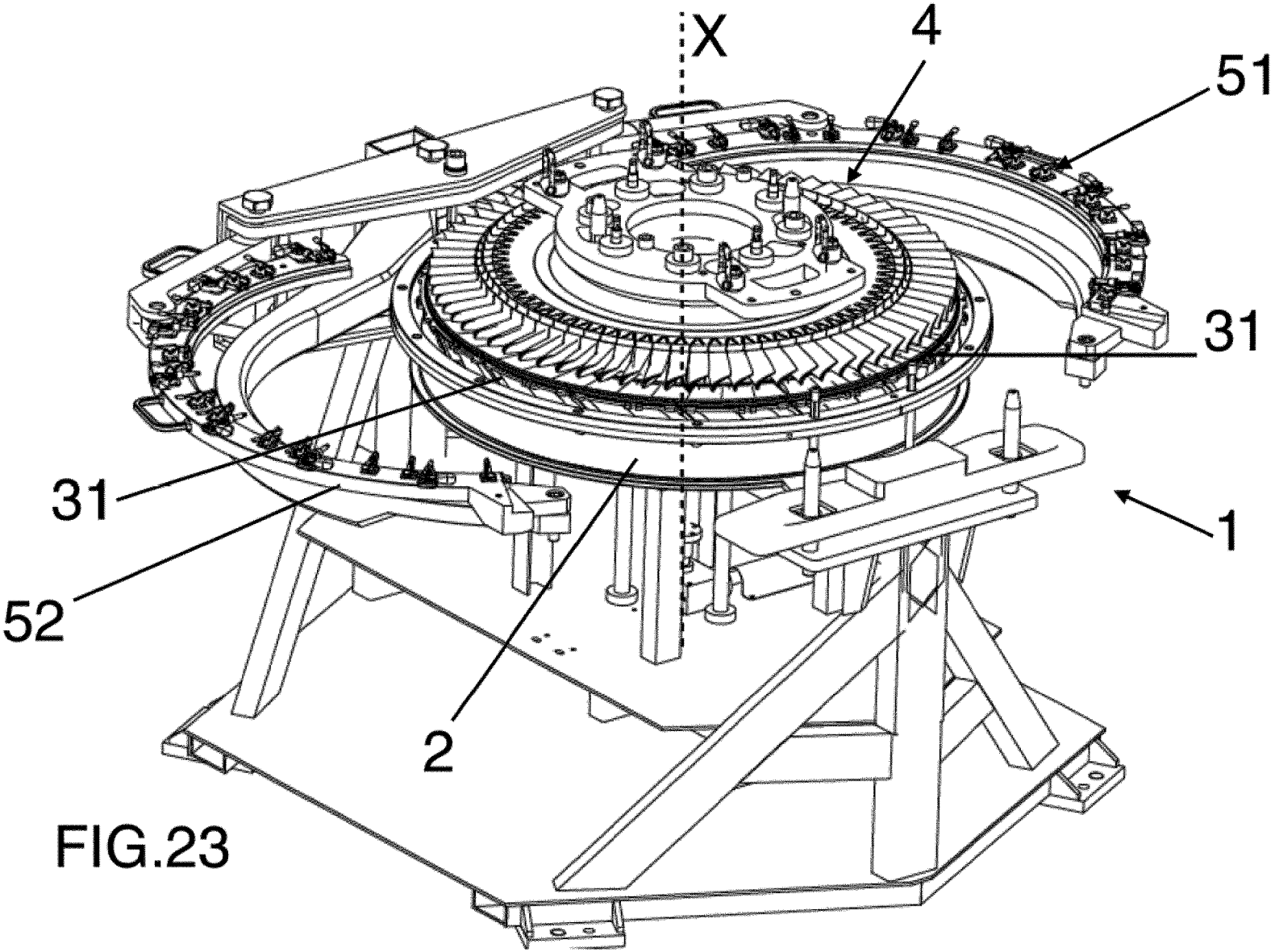
Figure 24:
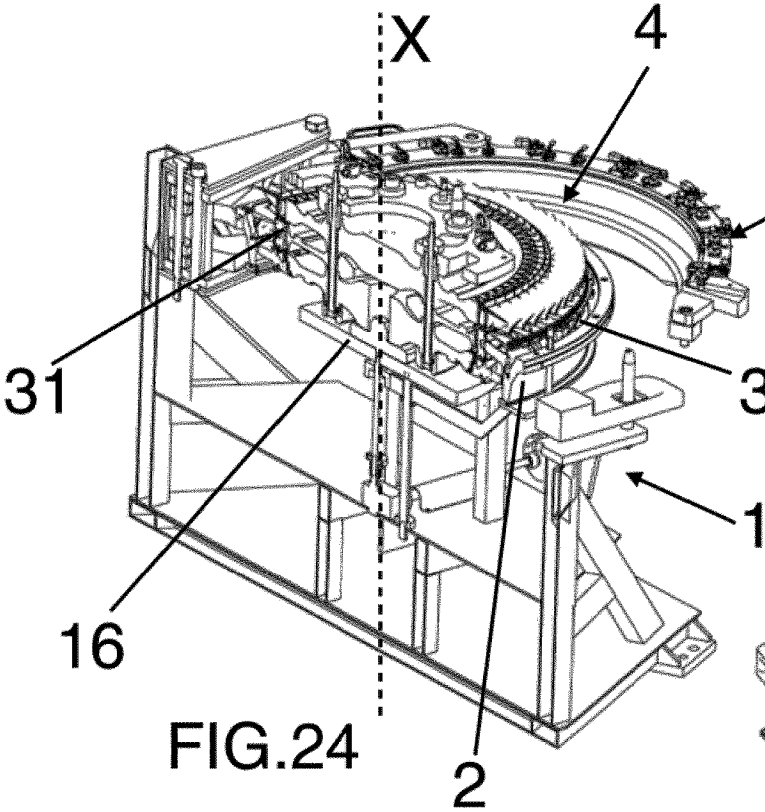
FIGS. 24 and 25 are partial sectional views of FIG. 23.
Figure 25:
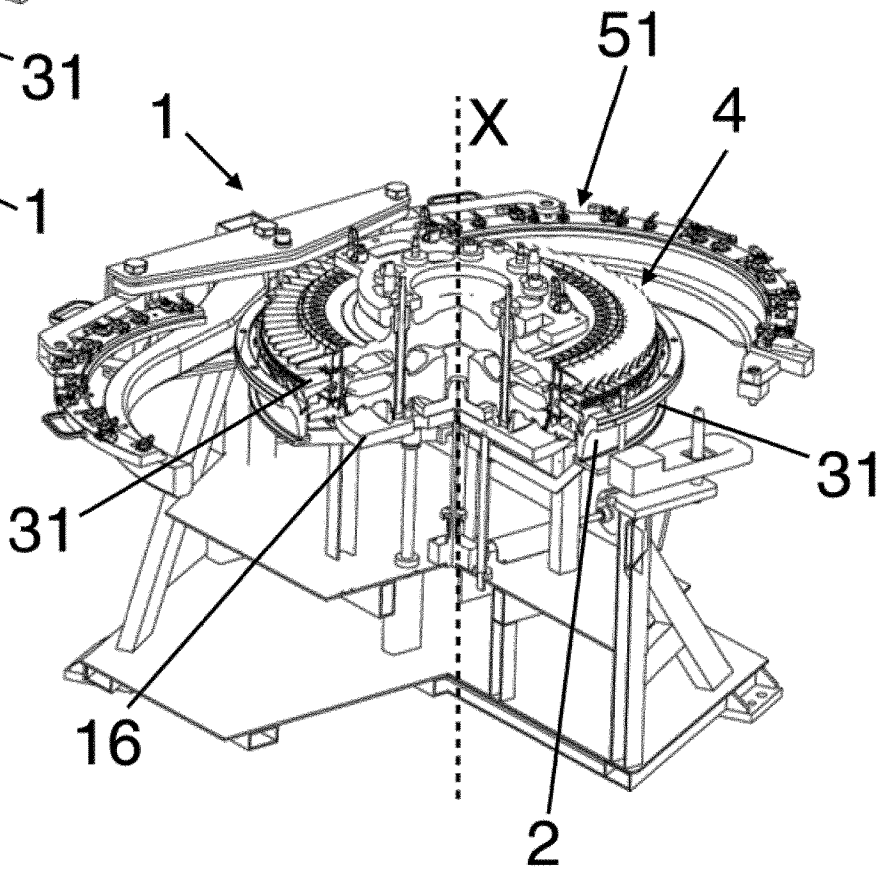

With reference to FIG. 23-25 the first stage annular casing 2 is moved toward the rotor 4 until it reaches an assembly position: using the apparatus 1 it can be obtained by moving the base 11 toward the rotor 4.

It must be noted that the movement of the first stage annular casing 2 in the assembly position would be prevented if the arms 51, 52 were still in the closed position: to this extent it appears more clearly the advantage of temporary supporting the nozzles 31 (since it allows removing the arms 51,52 freeing the movement of the casing 2).

Figure 26:
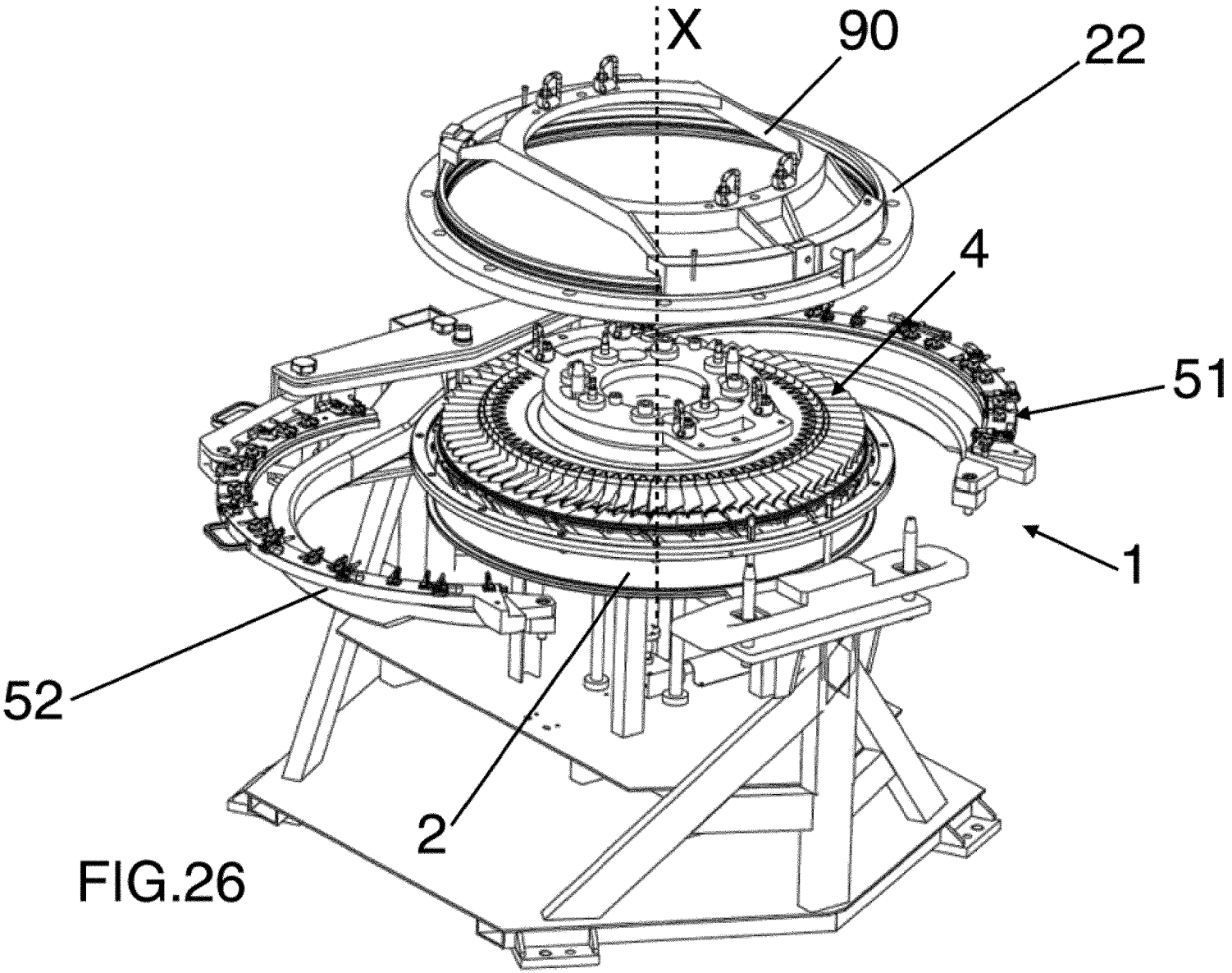
Figures 27, 28:
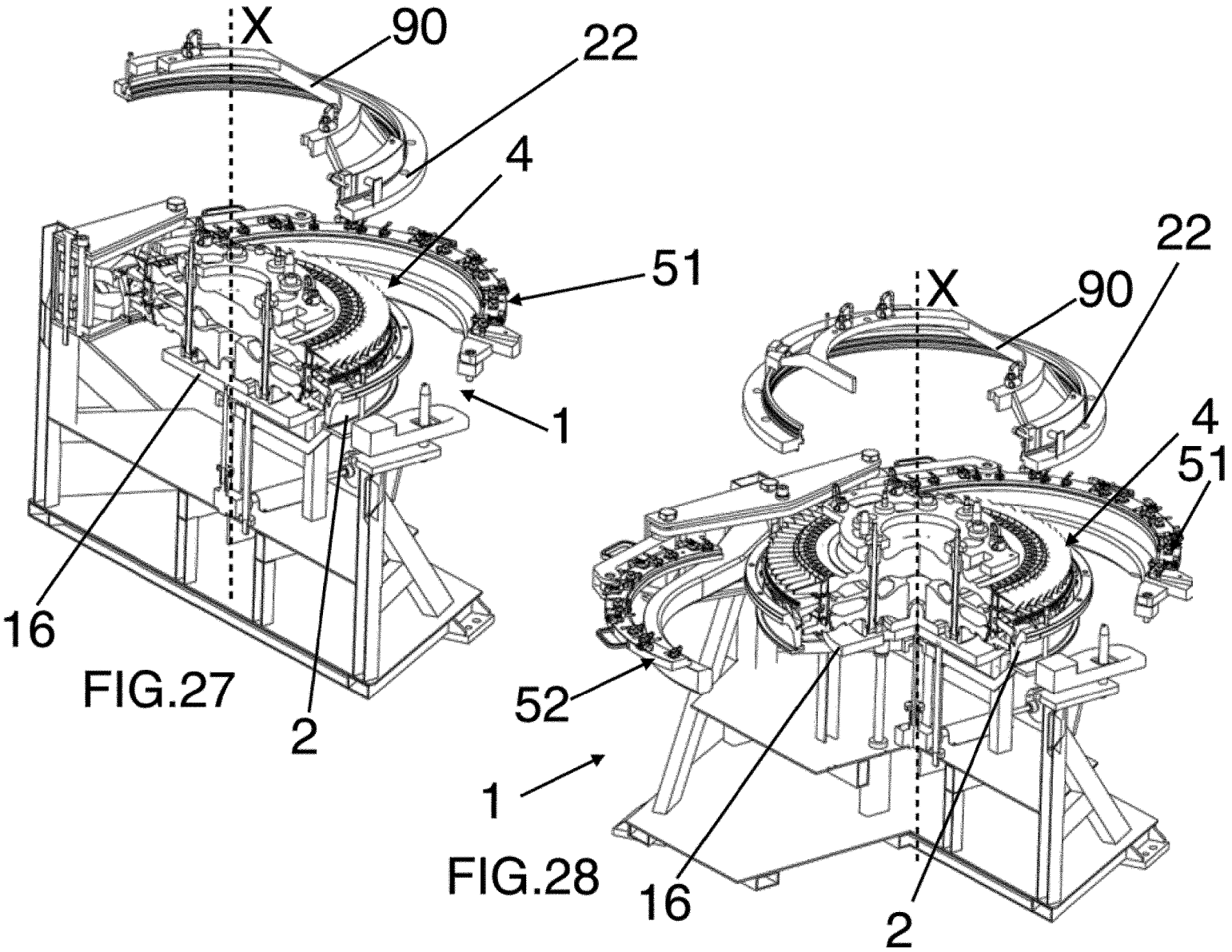
FIGS. 27 and 28 are partial sectional views of FIG. 26.
Figure 29:
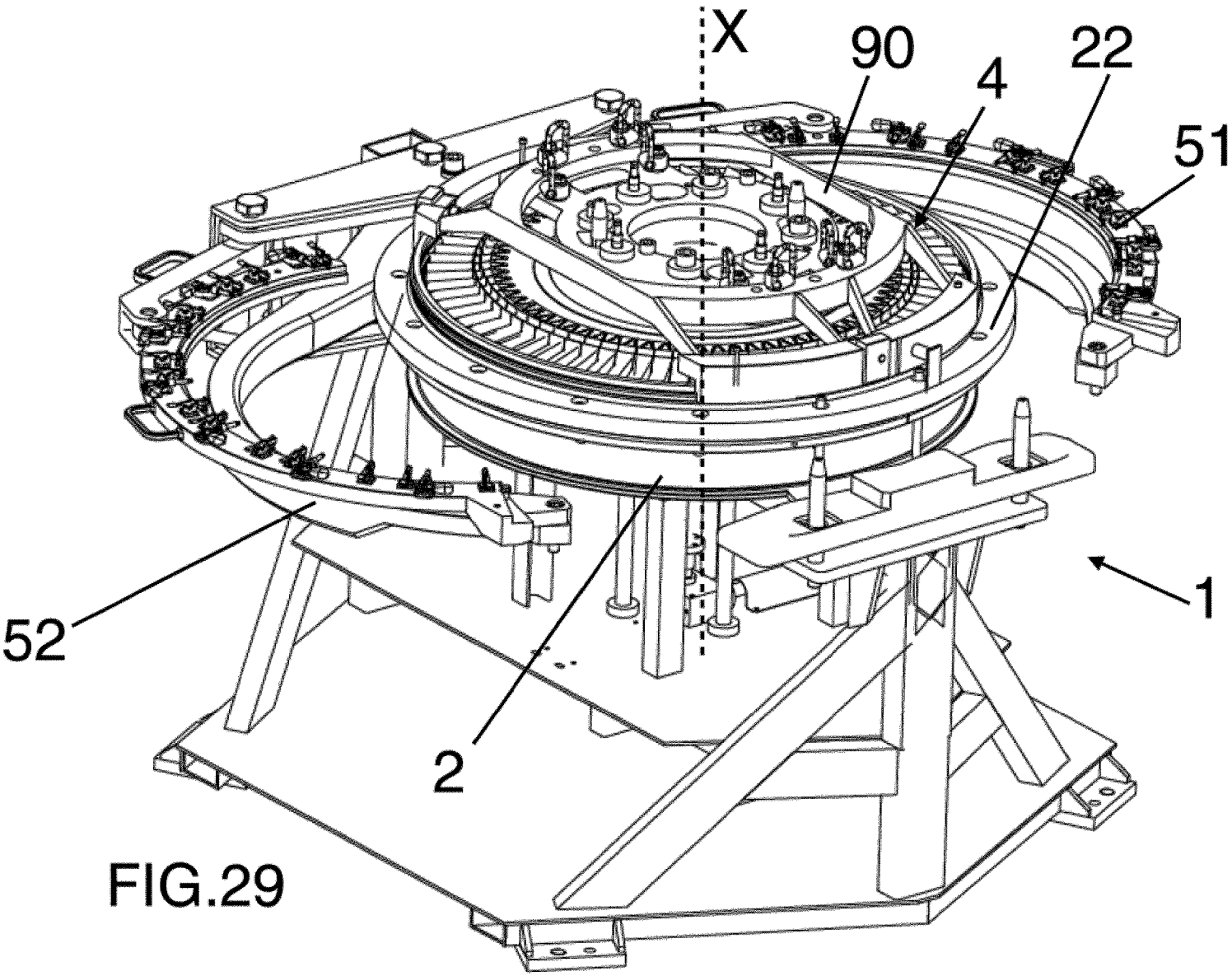
Figures 30, 31:
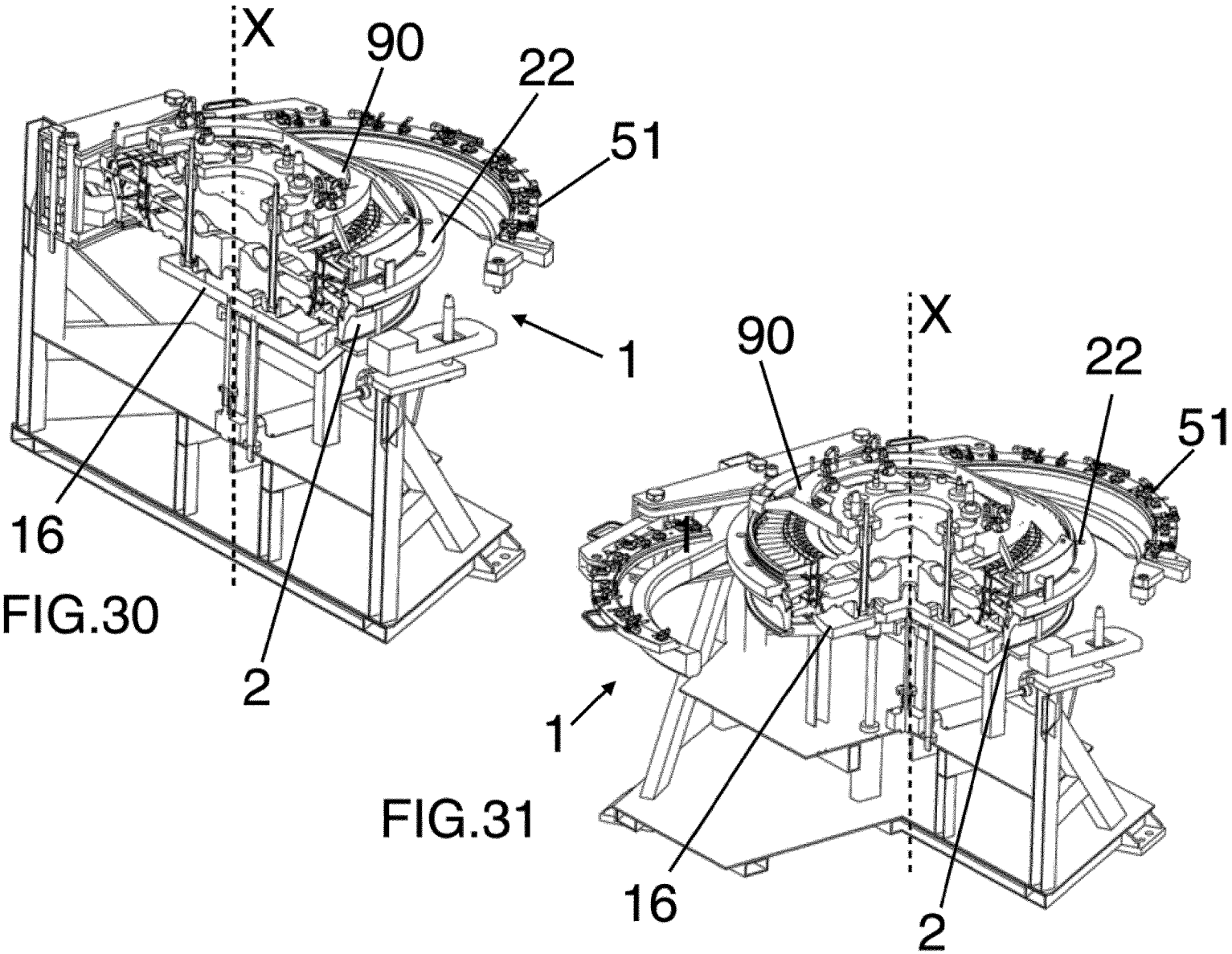
FIGS. 30 and 31 are partial sectional views of FIG. 29.
Figure 32:
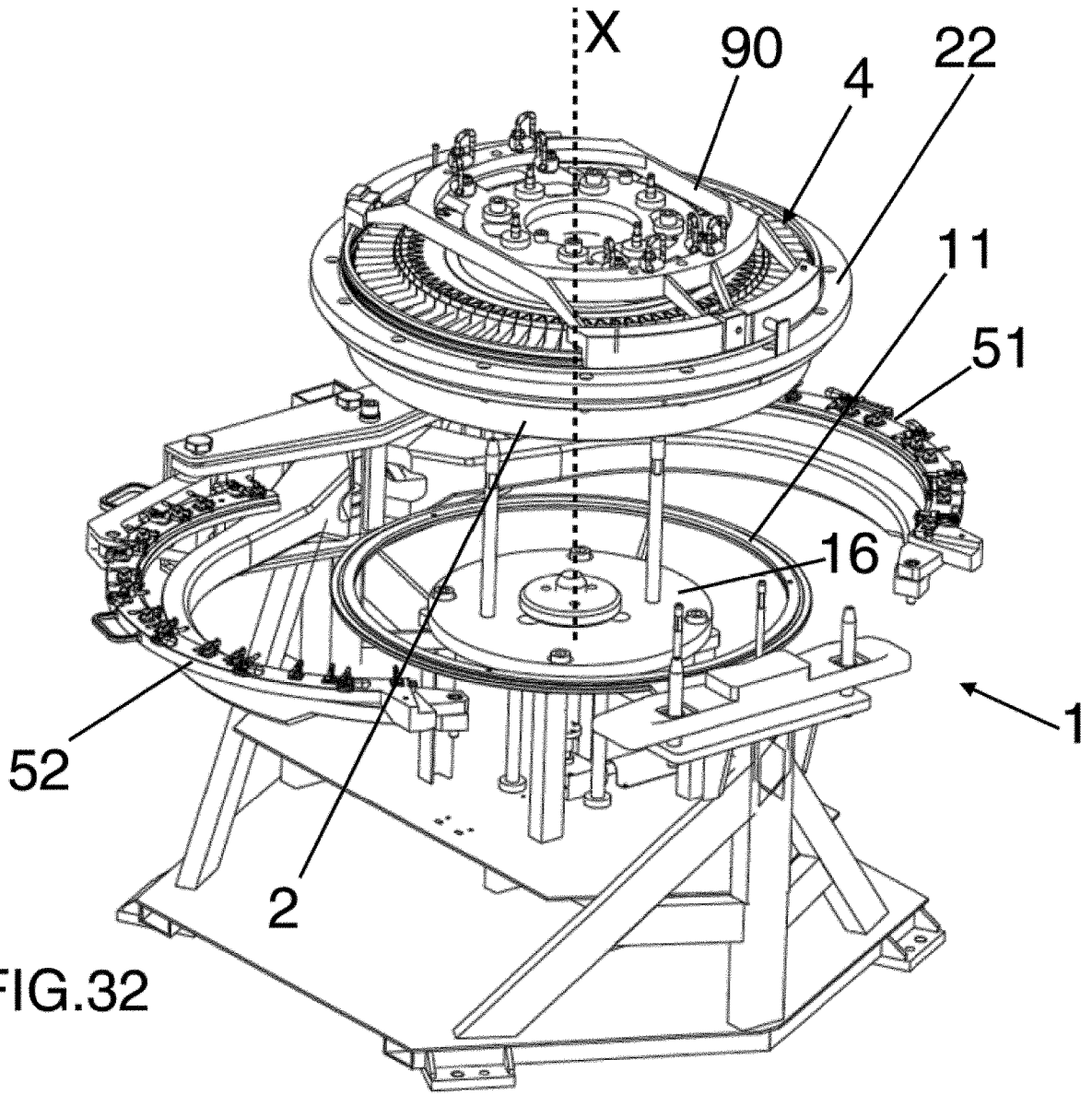
Figure 33:
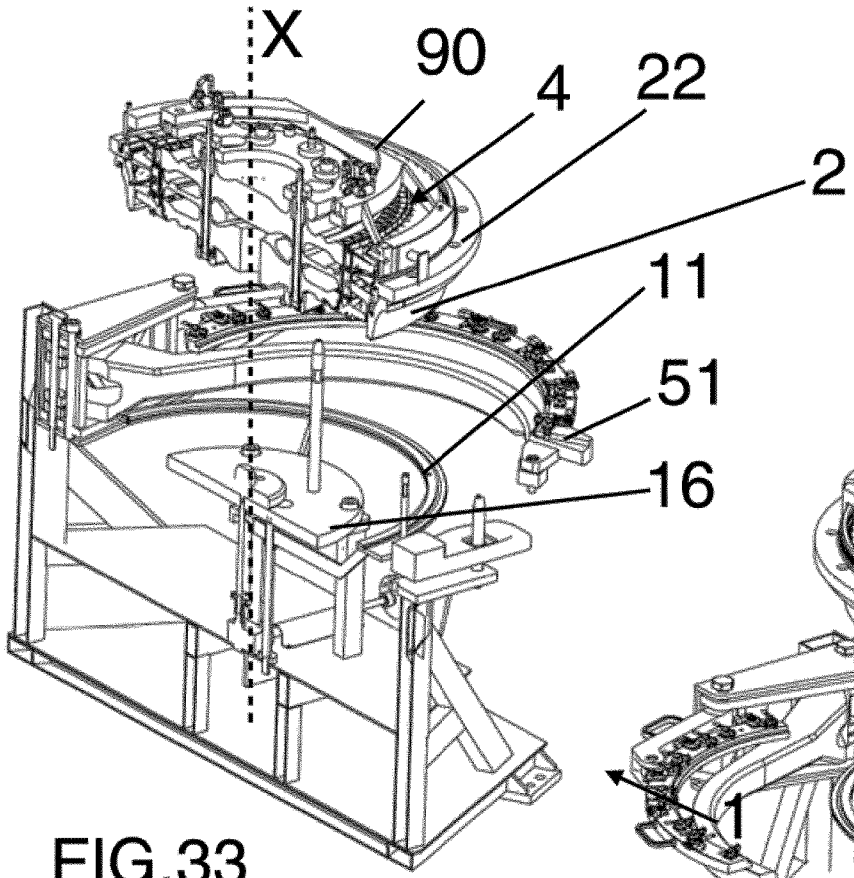
FIGS. 33 and 34 are partial sectional views of FIG. 32.
Figure 34:
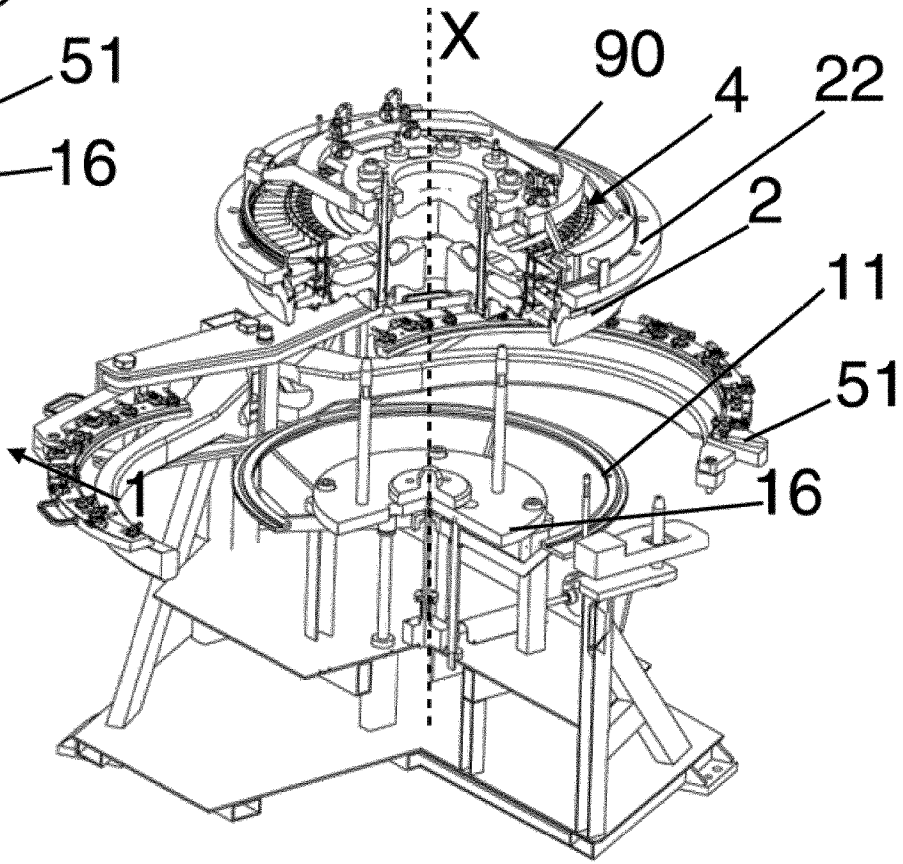

At this point a second stage annular casing 22 is provided, as shown in FIG. 26-28 and properly moved in an assembly position, as shown in FIG. 29-31 toward the rotor 4, until its abutment against the first stage annular casing 2.

Again, it must be noted the advantage achieved by the temporary support of the nozzles 31, that allows to have the clearance necessary to couple the two casing 2, 22, which closes the operative space in which the nozzles 31 are mounted.

The second stage annular casing 22 is fixed to the rotor 4 (and therefore supported by the latter) through the solidarization device 90, of the type known per se.

Step (g) of coupling the first and second annular casing 2, 22 is then performed; such coupling can take place through bolts or similar suitable couplings.

Removal of the temporary support devices can be now effected and the so assembled rotor-stator pack can be removed from the apparatus 1 and mounted in the turbine engine without the need of balancing the rotor.

It has to be stressed that the method herein above described can be performed with different apparatuses with respect to the apparatus 1.

Even if the apparatus 1 is used, then some modification can occur, for example it must be noted that instead of two arched arms 51, 52 supporting two group of nozzles, in other embodiment of the method (and of the corresponding apparatus) three, four or more arched arms and groups of nozzles are provided, according to the circumstances.

Nevertheless, having only two arched arms and two group of nozzles represent an embodiment, since in this way it is possible to achieve the advantages above said without enhancing the overall complexity of the apparatus 1.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An apparatus for assembling nozzles between buckets of a rotor, the apparatus comprising:

a main pedestal; a frame extending vertically from said pedestal, said frame comprising: a supporting base; at least two arched arms movable with respect of said supporting base; and a rotor support; said supporting base being movable along a first, vertical direction, and said at least two arched arms being movable between a first, opened position and a second, closed position.

2. The apparatus of claim 1, wherein said at least two arched arms are movable in a horizontal plane between said first and second position.

3. The apparatus of claim 1, wherein said at least two arched arms are movable between the first and second position by one of a roto-translational, a rotational or a translational movement.

4. The apparatus of claim 3, wherein each of said at least two arched arms is in the form of a four-bar linkage, the rotation axis of each hinge of the four-bar linkage being parallel to said first direction.

5. The apparatus of claim 1, wherein said at least two arched arms are provided with fixing devices for fixing in a pre-assembled position each nozzle.

6. The apparatus of claim 5, wherein said fixing devices comprises: a blocking plug for angularly fixing the position of the nozzle with respect to a rotor axis; a radial abutment; and an axial blocking lever to prevent axial movement of said nozzle with respect to the rotor axis.

* * * * *